US011267119B2

(12) United States Patent
Hoppe et al.

(10) Patent No.: US 11,267,119 B2
(45) Date of Patent: Mar. 8, 2022

(54) STORAGE DEVICE SYSTEM

(71) Applicant: Milwaukee Electric Tool Corporation, Brookfield, WI (US)

(72) Inventors: Christopher S. Hoppe, Milwaukee, WI (US); Matthew Vargo, Milwaukee, WI (US); Yaron Brunner, Kibbutz Gvat (IL)

(73) Assignees: Milwaukee Electric Tool Corporation, Brookfield, WI (US); Keter Plastic Ltd., Herzelyia (IL)

( * ) Notice: Subject to any disclaimer, the term of this patent is extended or adjusted under 35 U.S.C. 154(b) by 340 days.

(21) Appl. No.: 15/375,492

(22) Filed: Dec. 12, 2016

(65) Prior Publication Data

US 2017/0166352 A1 Jun. 15, 2017

Related U.S. Application Data

(60) Provisional application No. 62/267,071, filed on Dec. 14, 2015.

(51) Int. Cl.
*B65D 21/032* (2006.01)
*B25H 3/02* (2006.01)

(52) U.S. Cl.
CPC ..... *B25H 3/022* (2013.01)

(58) Field of Classification Search
CPC ..... B65D 21/0233; B25H 3/022
USPC ..... 220/23.88, 23.86; 206/519
See application file for complete search history.

(56) References Cited

U.S. PATENT DOCUMENTS

| | | | |
|---|---|---|---|
| 2,042,387 | A | 5/1936 | Cobb |
| 2,430,200 | A | 11/1947 | Wilson |
| 2,970,358 | A | 2/1961 | Elsner |
| 3,117,692 | A | 1/1964 | Carpenter et al. |
| 3,225,865 | A | 12/1965 | Downey |
| 3,506,321 | A | 4/1970 | Hampel |
| D232,798 | S | 9/1974 | Roche et al. |
| 3,974,898 | A | 8/1976 | Tullis et al. |
| 4,168,076 | A | 9/1979 | Johnson |

(Continued)

FOREIGN PATENT DOCUMENTS

| | | |
|---|---|---|
| CN | 2608238 | 3/2004 |
| CN | 200947356 | 9/2007 |

(Continued)

OTHER PUBLICATIONS

International Search Report and Written Opinion for International Application No. PCT/US2018/044629, dated Jan. 9, 2019.

(Continued)

*Primary Examiner* — Stephen J Castellano
(74) *Attorney, Agent, or Firm* — Reinhart Boerner Van Deuren s.c.

(57) ABSTRACT

A storage device system includes a storage case having a base and a cover coupled to the base, and a plurality of insertable bins removably positioned within an interior of the base. The plurality of insertable bins includes a first bin having a first height and a set of second bins each having a second height. The set of second bins is configured to be stackable and have a stacked height when stacked. A depth of the interior of the base, the first height, and the stacked height are equal.

16 Claims, 20 Drawing Sheets

(56) References Cited

U.S. PATENT DOCUMENTS 4,971,201 A * 11/1990 Sathre ..... B65D 5/0055 206/509
5,035,445 A 7/1991 Poulin
D319,016 S 8/1991 Kahl
5,098,235 A 3/1992 Svetlik et al.
D325,324 S 4/1992 Kahl
5,105,947 A * 4/1992 Wise ..... B65D 19/18 206/386
D326,815 S 6/1992 Meisner et al.
5,240,264 A 8/1993 Williams
D340,167 S 10/1993 Kahl
5,301,829 A 4/1994 Chrisco
D352,208 S 11/1994 Brookshire
5,429,260 A 7/1995 Vollers
D361,511 S 8/1995 Dickinson et al.
5,538,213 A 7/1996 Brown
5,595,228 A 1/1997 Meisner et al.
5,608,603 A 3/1997 Su
5,628,443 A 5/1997 Deutsch
D395,533 S 6/1998 Morison et al.
5,797,617 A 8/1998 Lin
5,951,037 A 9/1999 Hsieh
D415,393 S 10/1999 Kei
5,988,473 A 11/1999 Hagan et al.
D420,860 S 2/2000 Golichowski et al.
6,050,660 A 4/2000 Gurley
6,085,925 A 7/2000 Chung
6,109,627 A 8/2000 Be
6,176,559 B1 1/2001 Tiramani et al.
D437,669 S 2/2001 Blason et al.
6,305,498 B1 10/2001 Itzkovitch
6,347,847 B1 2/2002 Tiramani et al.
6,367,631 B1 4/2002 Steigerwald
6,371,320 B2 4/2002 Sagol
D456,972 S 5/2002 Blason et al.
6,431,580 B1 8/2002 Kady
6,547,347 B2 4/2003 Saito
6,601,930 B2 8/2003 Tiramani et al.
6,619,772 B2 9/2003 Dierbeck
6,637,707 B1 10/2003 Gates
6,641,013 B2 11/2003 Oise
6,945,546 B2 9/2005 Guirlinger
6,948,691 B2 9/2005 Brock et al.
6,983,946 B2 1/2006 Sullivan et al.
7,044,484 B2 5/2006 Wang
7,066,475 B2 6/2006 Barnes
D525,789 S 8/2006 Hosking
D527,225 S 8/2006 Krieger et al.
7,147,243 B2 12/2006 Kady
D536,580 S 2/2007 Krieger et al.
7,263,742 B2 9/2007 Valentini
7,367,571 B1 5/2008 Nichols
7,503,569 B2 3/2009 Duvigneau
7,658,887 B2 2/2010 Hovatter
7,779,764 B2 8/2010 Naidu et al.
7,780,026 B1 8/2010 Zuckerman
7,841,144 B2 11/2010 Pervan
D630,851 S 1/2011 Landau et al.
8,028,845 B2 10/2011 Himes
D649,350 S 11/2011 Shitrit
D653,832 S 2/2012 Vilkomirski et al.
8,132,819 B2 3/2012 Landau
8,177,463 B2 5/2012 Walker
D661,858 S 6/2012 Lifshitz et al.
8,191,910 B2 6/2012 Landau et al.
D663,952 S 7/2012 Crevling, Jr. et al.
D664,354 S 7/2012 Crevling, Jr. et al.
D668,869 S 10/2012 Yamamoto et al.
D674,605 S 1/2013 Vilkomirski et al.
8,454,033 B2 6/2013 Tsai
8,459,495 B2 6/2013 Koenig
8,505,729 B2 8/2013 Sosnovsky et al.
8,567,796 B2 10/2013 Bar-Erez et al.
8,677,661 B2 3/2014 Michels
D701,696 S 4/2014 Shitrit et al.
8,689,396 B2 4/2014 Wolfe
8,714,355 B2 5/2014 Huang
8,813,960 B2 8/2014 Fjelland
8,875,888 B2 11/2014 Koenig
8,979,100 B2 3/2015 Bensman et al.
8,985,922 B2 3/2015 Neumann
D738,105 S 9/2015 Shitrit
D738,106 S 9/2015 Shitrit
9,132,543 B2 9/2015 Bar-Erez
D753,394 S 4/2016 Brunner
D753,395 S 4/2016 Brunner
D753,396 S 4/2016 Brunner
D765,974 S 9/2016 Tonelli et al.
D770,179 S 11/2016 Menirom
9,506,489 B2 11/2016 Ko
9,511,491 B2 12/2016 Brunner
D777,426 S 1/2017 Dahl
9,566,990 B2 2/2017 Bar-Erez
D784,089 S 4/2017 Furneaux et al.
9,616,562 B2 4/2017 Hoppe
9,643,629 B2 5/2017 Bar-Erez et al.
D790,221 S 6/2017 Yahav et al.
9,701,443 B2 7/2017 Wang
9,725,209 B1 8/2017 Ben-Gigi
D803,631 S 11/2017 Min et al.
D806,483 S 1/2018 Stanford et al.
9,872,562 B2 1/2018 Brunner
D814,187 S 4/2018 Caglar
D815,831 S 4/2018 Tonelli
D816,334 S 5/2018 Brunner
D826,510 S 8/2018 Brunner
D828,671 S 9/2018 Cope et al.
D831,352 S 10/2018 Brunner
10,106,180 B2 10/2018 Bar-Erez et al.
D833,744 S 11/2018 Yahav et al.
D836,995 S 1/2019 Carey et al.
D839,681 S 2/2019 Evron et al.
D837,515 S 4/2019 Shpitzer
D845,080 S 4/2019 Jacobsen
D845,081 S 4/2019 Jacobsen
D857,387 S 8/2019 Shpitzer
10,434,638 B1 10/2019 Tsai
D871,013 S 12/2019 Liu
D873,085 S 1/2020 DeFrancia
10,583,962 B2 3/2020 Brunner et al.
D880,252 S 4/2020 Jacobsen
D880,951 S 4/2020 Jacobsen
D883,752 S 5/2020 Carey et al.
D887,788 S 6/2020 Meda et al.
D888,422 S 6/2020 Yang
D888,503 S 6/2020 Meda et al.
D891,193 S 6/2020 Stanford et al.
D891,195 S 7/2020 Zhou
D891,875 S 8/2020 Olson
D892,565 S 8/2020 Astle et al.
D895,375 S 9/2020 Hurley, Jr.
D895,966 S 9/2020 Brunner et al.
D895,967 S 9/2020 Brunner et al.
D896,517 S 9/2020 Brunner et al.
D896,518 S 9/2020 Brunner et al.
2002/0000440 A1 1/2002 Sagal et al.
2002/0125072 A1 9/2002 Levy
2002/0171228 A1 11/2002 Kady
2003/0094393 A1* 5/2003 Sahm, III ..... B65D 1/42 206/505
2003/0115715 A1 6/2003 Valentini
2003/0146589 A1 8/2003 Jarko et al.
2003/0184034 A1 10/2003 Pfeiffer
2003/0205877 A1 11/2003 Verna et al.
2004/0103494 A1 6/2004 Valentini
2004/0195793 A1 10/2004 Sullivan et al.
2004/0206656 A1 10/2004 Dubois et al.
2005/0062244 A1 3/2005 Guirlinger
2005/0104308 A1 5/2005 Barnes
2005/0139745 A1 6/2005 Liao
2006/0006770 A1 1/2006 Valentini
2006/0027475 A1 2/2006 Gleason et al.
2006/0038367 A9 2/2006 Ferraro
2006/0119060 A1 6/2006 Sullivan et al.

(56) References Cited

U.S. PATENT DOCUMENTS

| | | | |
|---|---|---|---|
| 2006/0186624 | A1 | 8/2006 | Kady |
| 2006/0254946 | A1 | 11/2006 | Becklin |
| 2007/0068757 | A1 | 3/2007 | Tan |
| 2007/0090616 | A1 | 4/2007 | Tompkins |
| 2007/0145700 | A1 | 6/2007 | Ambrose et al. |
| 2007/0194543 | A1 | 8/2007 | Duvingneau |
| 2008/0104921 | A1 | 5/2008 | Pervan |
| 2008/0115312 | A1 | 5/2008 | Dipasquale et al. |
| 2008/0121547 | A1 | 5/2008 | Dur et al. |
| 2008/0134607 | A1 | 6/2008 | Pervan |
| 2008/0169739 | A1 | 7/2008 | Goldenberg |
| 2008/0271280 | A1 | 11/2008 | Tiede et al. |
| 2008/0277221 | A1 | 11/2008 | Josefson |
| 2008/0308369 | A1 | 12/2008 | Louis |
| 2009/0026901 | A1 | 1/2009 | Nies, III et al. |
| 2009/0071990 | A1 | 3/2009 | Jardine et al. |
| 2009/0145790 | A1 | 6/2009 | Panosian |
| 2009/0145866 | A1 | 6/2009 | Panosian et al. |
| 2009/0145913 | A1 | 6/2009 | Panosian et al. |
| 2009/0178946 | A1 | 7/2009 | Patstone et al. |
| 2009/0236482 | A1 | 9/2009 | Winig et al. |
| 2010/0052276 | A1 | 3/2010 | Brunner |
| 2010/0139566 | A1* | 6/2010 | Lopuszanski ..... A01K 63/02 119/6.7 |
| 2010/0147642 | A1 | 6/2010 | Andochick |
| 2010/0219193 | A1 | 9/2010 | Becklin |
| 2011/0073516 | A1 | 3/2011 | Zelinskiy |
| 2011/0139665 | A1 | 6/2011 | Madsen |
| 2011/0155613 | A1 | 6/2011 | Koenig et al. |
| 2011/0174939 | A1 | 7/2011 | Taylor |
| 2011/0181008 | A1 | 7/2011 | Bensman |
| 2011/0220531 | A1 | 9/2011 | Meether et al. |
| 2012/0160886 | A1 | 6/2012 | Henny et al. |
| 2012/0180250 | A1 | 7/2012 | Ricklefsen et al. |
| 2012/0207571 | A1 | 8/2012 | Scott |
| 2012/0292213 | A1 | 11/2012 | Brunner |
| 2012/0326406 | A1 | 12/2012 | Lifshitz |
| 2013/0024468 | A1* | 1/2013 | Kocsis ..... B65D 77/0446 707/758 |
| 2013/0031731 | A1 | 2/2013 | Hess |
| 2013/0031732 | A1 | 2/2013 | Hess et al. |
| 2013/0068903 | A1 | 3/2013 | O'Keene |
| 2013/0121783 | A1 | 5/2013 | Kelly |
| 2013/0127129 | A1 | 5/2013 | Bensman et al. |
| 2013/0146551 | A1 | 6/2013 | Simpson et al. |
| 2013/0154218 | A1 | 6/2013 | Tiilikainen |
| 2013/0223971 | A1 | 8/2013 | Grace, IV |
| 2014/0076759 | A1 | 3/2014 | Roehm et al. |
| 2014/0161518 | A1 | 6/2014 | Ko |
| 2014/0166516 | A1 | 6/2014 | Martinez |
| 2015/0034515 | A1 | 2/2015 | Monyak et al. |
| 2015/0274362 | A1 | 10/2015 | Christopher et al. |
| 2015/0376917 | A1 | 12/2015 | Brunner |
| 2016/0023349 | A1 | 1/2016 | Hoppe et al. |
| 2016/0130034 | A1 | 5/2016 | Kuhls |
| 2016/0144500 | A1 | 5/2016 | Chen |
| 2016/0168880 | A1 | 6/2016 | Phelan |
| 2016/0221177 | A1 | 8/2016 | Reinhart |
| 2017/0121056 | A1 | 5/2017 | Wang |
| 2017/0138382 | A1 | 5/2017 | Ko |
| 2017/0165828 | A1 | 6/2017 | Fleischmann |
| 2017/0166352 | A1 | 6/2017 | Hoppe |
| 2017/0174392 | A1 | 6/2017 | De Loynes |
| 2017/0217464 | A1 | 8/2017 | Bar-erez et al. |
| 2017/0239808 | A1 | 8/2017 | Hoppe |
| 2017/0257958 | A1 | 9/2017 | Sabbag et al. |
| 2017/0266804 | A1 | 9/2017 | Kinskey |
| 2017/0318927 | A1 | 11/2017 | Kraus |
| 2017/0349013 | A1 | 12/2017 | Gronholm |
| 2018/0044059 | A1 | 2/2018 | Brunner |
| 2018/0099405 | A1 | 4/2018 | Reinhart |
| 2018/0153312 | A1 | 6/2018 | Buck et al. |
| 2018/0161975 | A1 | 6/2018 | Brunner |
| 2018/0186513 | A1 | 7/2018 | Brunner |
| 2018/0220758 | A1 | 8/2018 | Burchia |
| 2018/0290288 | A1 | 10/2018 | Brunner |
| 2019/0002004 | A1 | 1/2019 | Brunner |
| 2019/0031222 | A1 | 1/2019 | Takyar et al. |
| 2019/0039781 | A1 | 2/2019 | Kogel |
| 2019/0106244 | A1 | 4/2019 | Brunner et al. |
| 2019/0225371 | A1 | 7/2019 | Hoppe et al. |
| 2020/0055534 | A1 | 2/2020 | Hassell |
| 2020/0147781 | A1 | 5/2020 | Squiers et al. |
| 2020/0165036 | A1 | 5/2020 | Squiers et al. |
| 2020/0243925 | A1 | 7/2020 | Polakowski et al. |
| 2020/0299027 | A1 | 9/2020 | Brunner et al. |

FOREIGN PATENT DOCUMENTS

| | | |
|---|---|---|
| CN | 101068661 | 11/2007 |
| CN | 102137795 | 7/2011 |
| CN | 102248523 | 11/2011 |
| CN | 102469899 | 5/2012 |
| CN | 102608238 | 7/2012 |
| CN | 102834035 | 12/2012 |
| CN | 302371147 | 3/2013 |
| CN | 103118578 | 5/2013 |
| CN | 103659777 | 3/2014 |
| CN | 204161752 | 2/2015 |
| DE | 3510307 | 9/1986 |
| DE | 9313802 | 12/1993 |
| DE | 4415638 | 11/1995 |
| DE | 29708343 | 7/1997 |
| DE | 19750543 | 5/1999 |
| DE | 20218996 | 3/2003 |
| DE | 102004057870 | 6/2006 |
| DE | 202011002617 | 4/2011 |
| DE | 102010003754 | 10/2011 |
| DE | 102010003756 | 10/2011 |
| DE | 102012106482 | 1/2014 |
| DE | 102012220837 | 5/2014 |
| DE | 202014103695 | 10/2014 |
| DE | 202015105053 | 10/2016 |
| DE | 202015005752 | 11/2016 |
| DE | 102015112204 | 2/2017 |
| DE | 102015013053 | 4/2017 |
| DE | 402018201520 | 5/2018 |
| EM | 000705231-0001 | 4/2007 |
| EM | 002419283-0001 | 3/2014 |
| EP | 0916302 | 5/1999 |
| EP | 1321247 | 6/2003 |
| EP | 1428764 | 6/2004 |
| EP | 1428764 B1 | 6/2004 |
| EP | 1819487 | 8/2007 |
| EP | 2289671 | 3/2011 |
| EP | 2346741 | 7/2011 |
| EP | 2456341 | 5/2012 |
| EP | 2555660 | 2/2013 |
| EP | 2555661 | 2/2013 |
| EP | 2805799 | 11/2016 |
| EP | 3141354 | 3/2017 |
| GB | 694707 | 7/1953 |
| GB | 2047181 B | 2/1983 |
| GB | 2110076 | 6/1983 |
| GB | 2330521 | 4/1999 |
| GB | 2406331 | 3/2005 |
| GB | 2413265 | 10/2005 |
| GB | 2449934 | 12/2008 |
| JP | 2003194020 A | 7/2003 |
| JP | D1180963 | 8/2003 |
| JP | 1276744 | 7/2006 |
| JP | D1395115 | 8/2010 |
| JP | D1395116 | 8/2010 |
| JP | D1455321 | 11/2012 |
| JP | 2013022972 | 2/2013 |
| JP | 2013022976 | 2/2013 |
| JP | 1477050 | 8/2013 |
| JP | D1503434 | 7/2014 |
| JP | D1625407 | 2/2019 |
| JP | D1665028 | 8/2020 |
| KR | 30-0271616 | 2/2000 |
| KR | 30-0320243 | 6/2002 |
| KR | 3008066040000 | 7/2015 |
| KR | 3008422360000 | 3/2016 |

(56) References Cited

FOREIGN PATENT DOCUMENTS

| | | | |
|---|---|---|---|
| KR | 3008496000000 | | 4/2016 |
| KR | 3008599650000 | | 6/2016 |
| KR | 3008812960000 | | 11/2016 |
| KR | 3009995990000 | | 3/2019 |
| TW | 206875 | | 5/1993 |
| TW | I324578 | | 5/2010 |
| TW | 135074 | | 6/2010 |
| TW | 168686 | | 7/2015 |
| TW | 174412 | | 3/2016 |
| TW | D192092 | | 8/2018 |
| WO | WO2005/045886 | | 5/2005 |
| WO | WO2007/121746 | | 11/2007 |
| WO | WO07121745 | | 11/2007 |
| WO | WO07121746 | | 11/2007 |
| WO | WO2007121745 | A1 | 11/2007 |
| WO | WO2009/140965 | | 11/2009 |
| WO | WO09140965 | | 11/2009 |
| WO | WO2011/009480 | | 1/2011 |
| WO | WO11009480 | | 1/2011 |
| WO | WO2013/026084 | | 2/2013 |
| WO | WO13026084 | | 2/2013 |
| WO | WO2014/125488 | | 8/2014 |
| WO | WO14125488 | | 8/2014 |
| WO | WO 2016142935 | | 9/2016 |
| WO | WO 2017028845 | | 2/2017 |
| WO | WO2017191628 | | 11/2017 |
| WO | WO2017/212840 | | 12/2017 |
| WO | WO17212840 | | 12/2017 |

OTHER PUBLICATIONS

International Search Report and Written Opinion for International Application No. PCT/US2018/033161, dated Aug. 6, 2018.

International Search Report and Written Opinion for International Application No. PCT/US2019/014940, dated Jul. 26, 2019, 9 pages.

Non-Final Rejection dated Apr. 12, 2018, in U.S. Appl. No. 15/826,201. (16 Pages).

Stuart, "Sys-Cart Base, a Systainer Mounting Platform," ToolGuyd, Jul. 28, 2014, https://toolguyd.com/systainer-sys-cart-mounting-base/, 11 pages.

"BluCave Universal Storage System," Batavia Tools to Build, https://batavia.eu/blucave-storage-system/, believed to be available at least as early as Nov. 29, 2017, 5 pages.

"Dewait TSTAK Carrier Trolley," ITS, https://www.its.co.uk/pd/171229-Dewalt-TSTAK-Carrier-Trolley-_DEW171229.htm, Per Wayback, website dates back to May 2, 2015, 2 pages.

"Tool Skool, TSTAK Phase 2 Upgrades | TSTAK Carts—First Look—Tool Skool," YouTube, Sep. 7, 2013, https://www.youtube.com/watch?v=jb06y6J1dr4&feature=youtu.be&t=197, 1 page.

"DeWalt TSTAK Vac Rack (Suits DW DWV902M & DWV900L) DWV9500-XJ," Get Tools Direct, https://www.gettoolsdirect.com.au/dewalt-tstak-vac-rack-suits-dwv902m-and-dwv900l-dwv9500-xj.html, believed to be available at least as early as Nov. 29, 2017, 4 pages.

Stuart, "Ryobi ToolBloxTool Cabinet System!," ToolGuyd, Sep. 18, 2014, https://toolguyd.com/ryobi-toolblox-cabinets/, 23 pages.

"Blitz Box—Portable Storage Box / Shelf," The Green Head Finds Cool New Stuff, https://www.thegreenhead.com/2013/03/blitz-box-portable-storage-box-shelf.php, Per Wayback, website dates back to Feb. 15, 2015, 5 pages.

"Hopkins FloTool 91002 Rhino Box with Mount," Amazon.com, https://www.amazon.com/exec/obidos/ASIN/B003K15F3I/20140000-20, believed to be available at least as early as Nov. 29, 2017, 7 pages.

Sortimo Logistix, "Mobile Sortimente", brochure, believed to be available at least as early as Nov. 29, 2017, 17 pages.

BluCave Video, https://www.youtube.com/watch?v=Sw7fQQPwoOtY&feature=youtu.be&t=32, believed to be available at least as early as Nov. 29, 2017.

Batavia Gmbh, BluCave Storage System, https://protect-us.mimecast.com/s/5XIGCR6KypcqJnIKi9EDoim?domaini=batavia.eu, believed to be available at least as early as Nov. 29, 2017, 7 pages.

Vertak, https://www.alibaba.com/product-detail/Vertak-global-patented-multi-funciton-portable_602177946260.html, believed to be available at least as early as Nov. 29, 2017.

International Search Report and Written Opinion for International Application No. PCT/IL2019/050689, dated Aug. 23, 2019, 21 pages.

Stuart, "Sys-Cart Base, a Systainer Mounting Platform," ToolGuyd, allegedly available on Jul. 28, 2014, https://toolguyd.com/systainer-sys-cart-mounting-base/,10 pages.

"BluCave Universal Storage System," Batavia Tools to Build, https://batavia.eu/blucave-storage-system/, available at least as early as Jun. 11, 2019, 9 pages.

"Dewait TSTAK Carrier Trolley," ITS, https://www.its.co.uk/pd/171229-Dewalt-TSTAK-Carrier-Trolley-_DEW171229.htm, available at least as early as Jun. 11, 2019, 3 pages.

"Tool Skool, TSTAK Phase 2 Upgrades | TSTAK Carts—First Look-Tool Skool," YouTube, allegedly available on Sep. 7, 2013, https://www.youtube.com/watch?v=jb06y6J1dr4&feature=youtu.be&t=197, 1 page.

"DeWalt TSTAK Vac Rack (Suits DW DWV902M & DWV900L) DWV9500-XJ," Get Tools Direct, https://www.gettoolsdirect.com.au/dewalt-tstak-vac-rack-suits-dwv902m-and-dwv900I-dwv9500-xj.html, available at least as early as Jun. 11, 2019, 4 pages.

Stuart, "Ryobi ToolBloxTool Cabinet System!," ToolGuyd, allegedly available on Sep. 19, 2014, https://toolguyd.com/ryobi-toolblox-cabinets/, 23 pages.

"Blitz Box—Portable Storage Box / Shelf," The Green Head Finds Cool New Stuff, https://www.thegreenhead.com/2013/03/blitz-box-portable-storage-box-shelf.php, Available at least as early as Jun. 11, 2019, 8 pages.

"Hopkins FloTool 91002 Rhino Box with Mount," Amazon.com, https://www.amazon.com/exec/obidos/ASIN/B003K15F3I/20140000-20, Available at least as early as Jun. 11, 2019, 7 pages.

Sortimo Logistix, "Mobile Sortimente", brochure, Available at least as early as Jun. 11, 2019, 17 pages.

International Search Report and Written Opinion for International Application No. PCT/IL2020/050433, dated Jun. 21, 2020, 14 pages.

* cited by examiner

STORAGE DEVICE SYSTEM

CROSS-REFERENCE TO RELATED APPLICATION

This application claims priority to U.S. Provisional Patent Application No. 62/267,071, filed on Dec. 14, 2015, the entire contents of which are hereby incorporated by reference.

BACKGROUND

The present invention relates to storage devices, including bags, storage totes, tool boxes and organizers.

Tool storage devices are often used to transport tools and accessories. Tool storage devices include soft-sided storage devices such as a tool bags, and rigid storage devices such as tool boxes and organizers. Soft-sided storage devices include walls made of flexible material and typically have a bottom made of a rigid material. Rigid storage devices include a rigid base and a rigid cover coupled thereto. The rigid base may include dividers and storage compartments for storing and organizing tools and accessories.

SUMMARY

In one embodiment, the invention provides a storage device system including a storage case having a base and a cover coupled to the base, and a plurality of insertable bins removably positioned within an interior of the base. The plurality of insertable bins includes a first bin having a first height and a set of second bins each having a second height. The set of second bins is configured to be stackable and have a stacked height when stacked. A depth of the interior of the base, the first height, and the stacked height are equal.

In another embodiment, the invention provides a storage device system including a storage case having a base and a cover coupled to the base, and a plurality of insertable bins removably positioned within an interior of the base. The insertable bins include a first bin and a second bin configured to be stackable. The first bin has a ledge formed on an inner surface of the first bin. The ledge is configured to engage and support the second bin when the second bin is stacked on the first bin. The second bin has a rib on an outer surface to inhibit suctioning when the second bin is stacked on the first bin.

In yet another embodiment, the invention provides a storage device system including a soft-sided storage device having a rigid bottom, and a rigid storage device having a top that interfaces with the bottom of the soft-sided storage device. The storage device system further includes a latch assembly operable to secure the soft-sided storage device and the rigid storage device together. The soft-sided storage device and the rigid storage device being carryable as a coupled unit.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
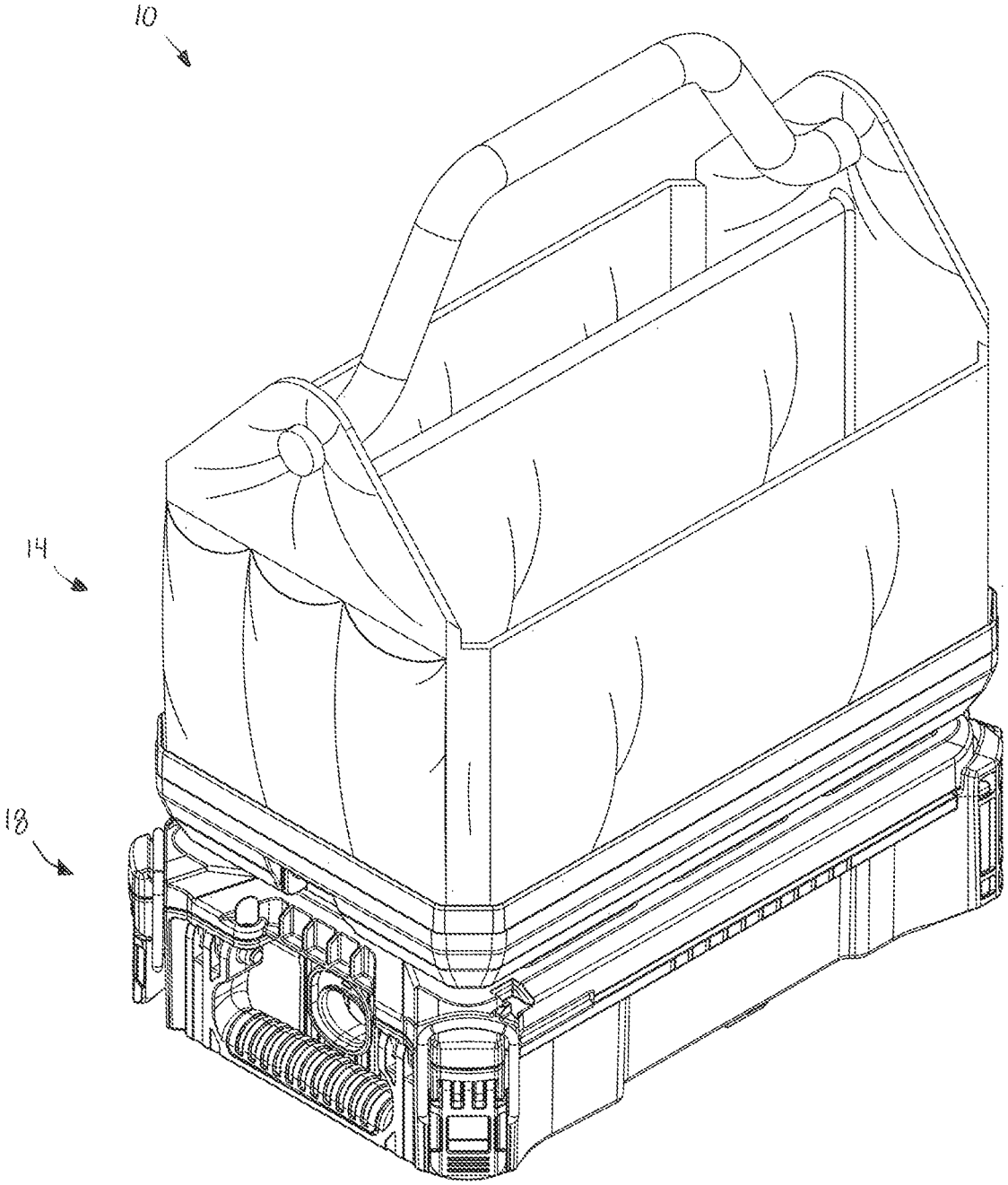
FIG. 1 is a perspective view of a storage device system including a soft-sided storage device coupled to a rigid storage device.

FIG. 1 illustrates a storage device system 10 including a soft-sided storage device 14, such as soft-sided bag, removably coupled to a hard-sided or rigid storage device 18, such as a rigid storage case (e.g., a rigid tool box or organizer).

Figure 2:
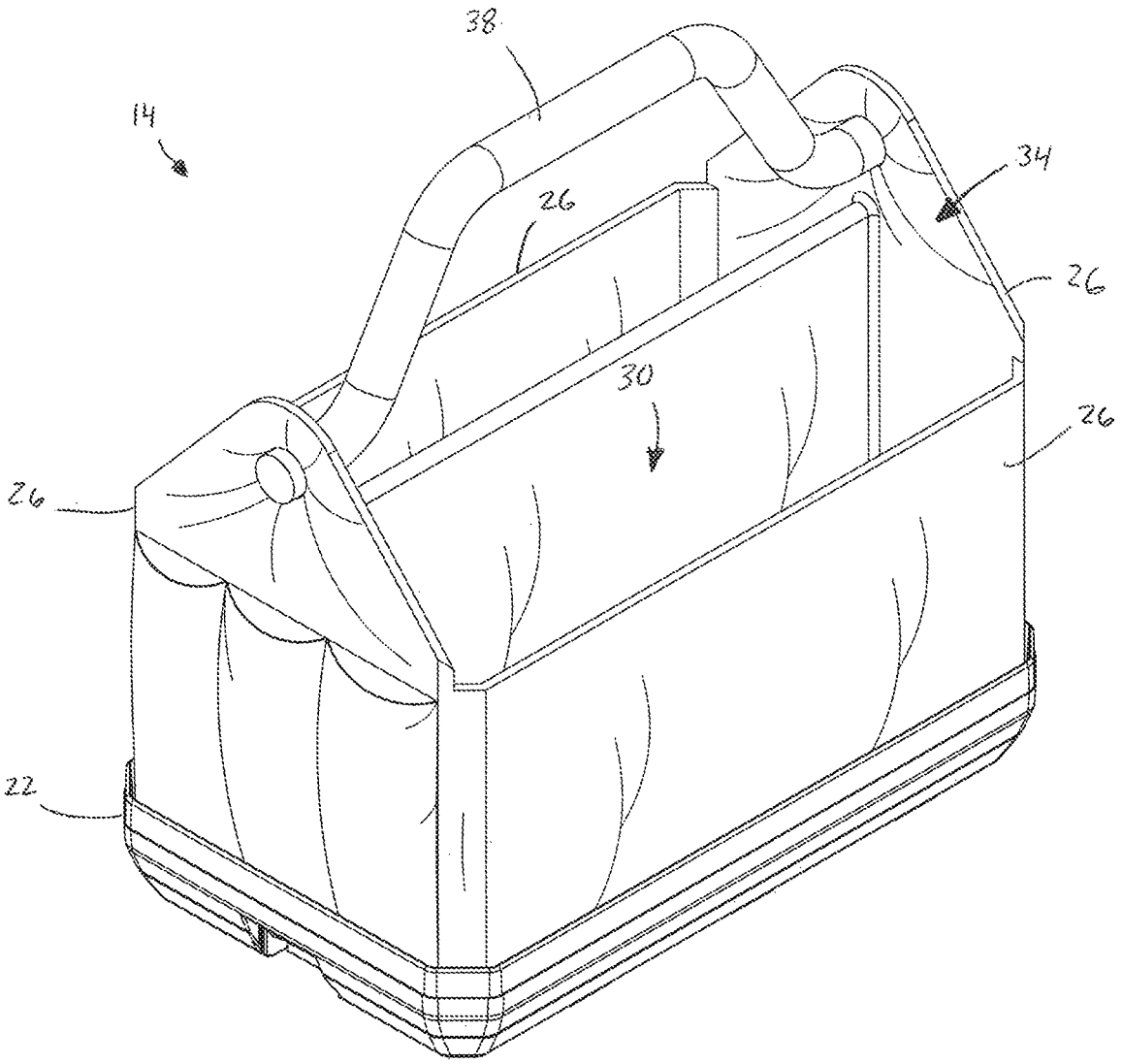
FIG. 2 is a perspective view of the soft-sided storage device of FIG. 1.
Figure 3:
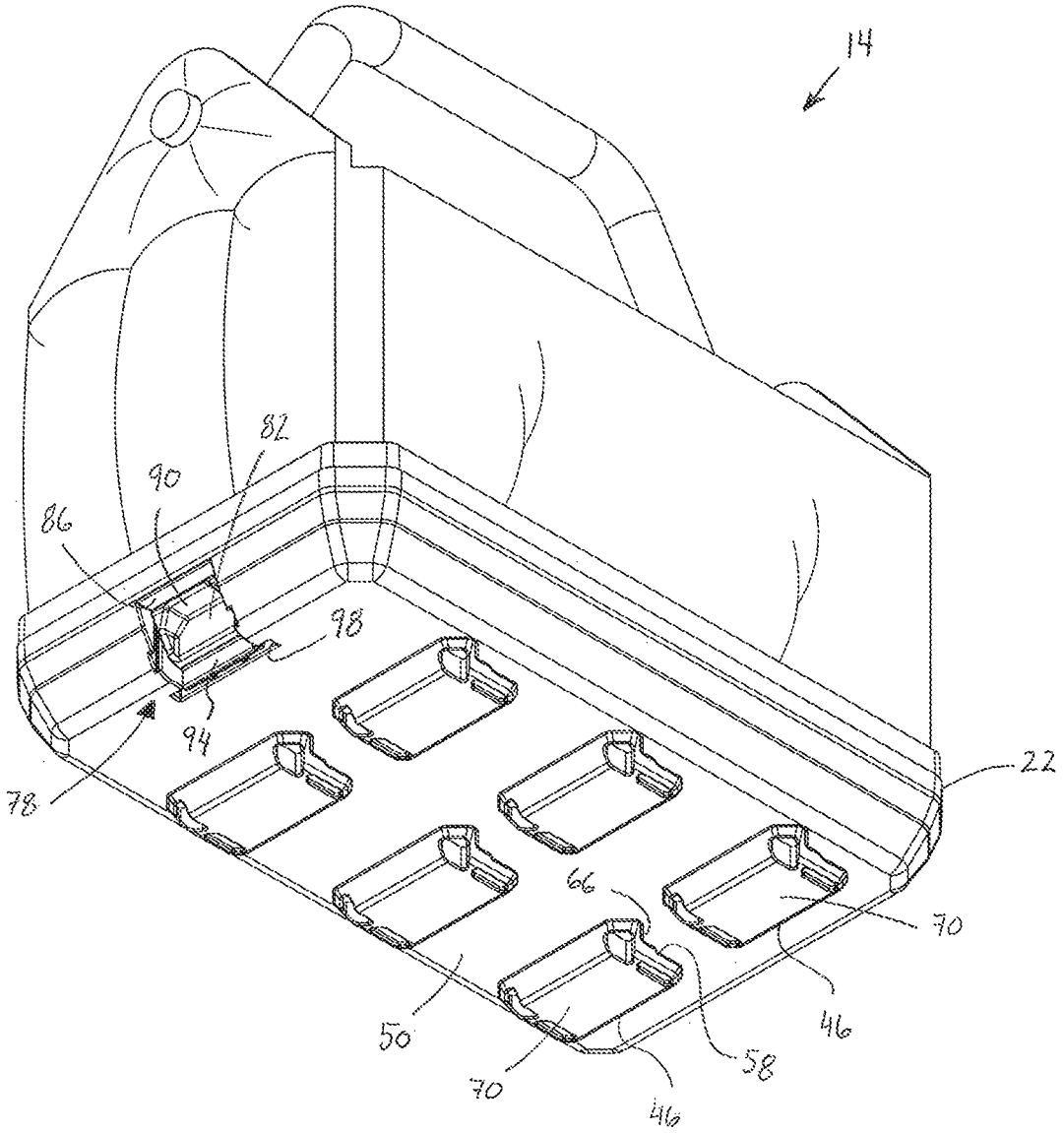
FIG. 3 is a bottom perspective view of the soft-sided storage device of FIG. 2.
Figure 4:
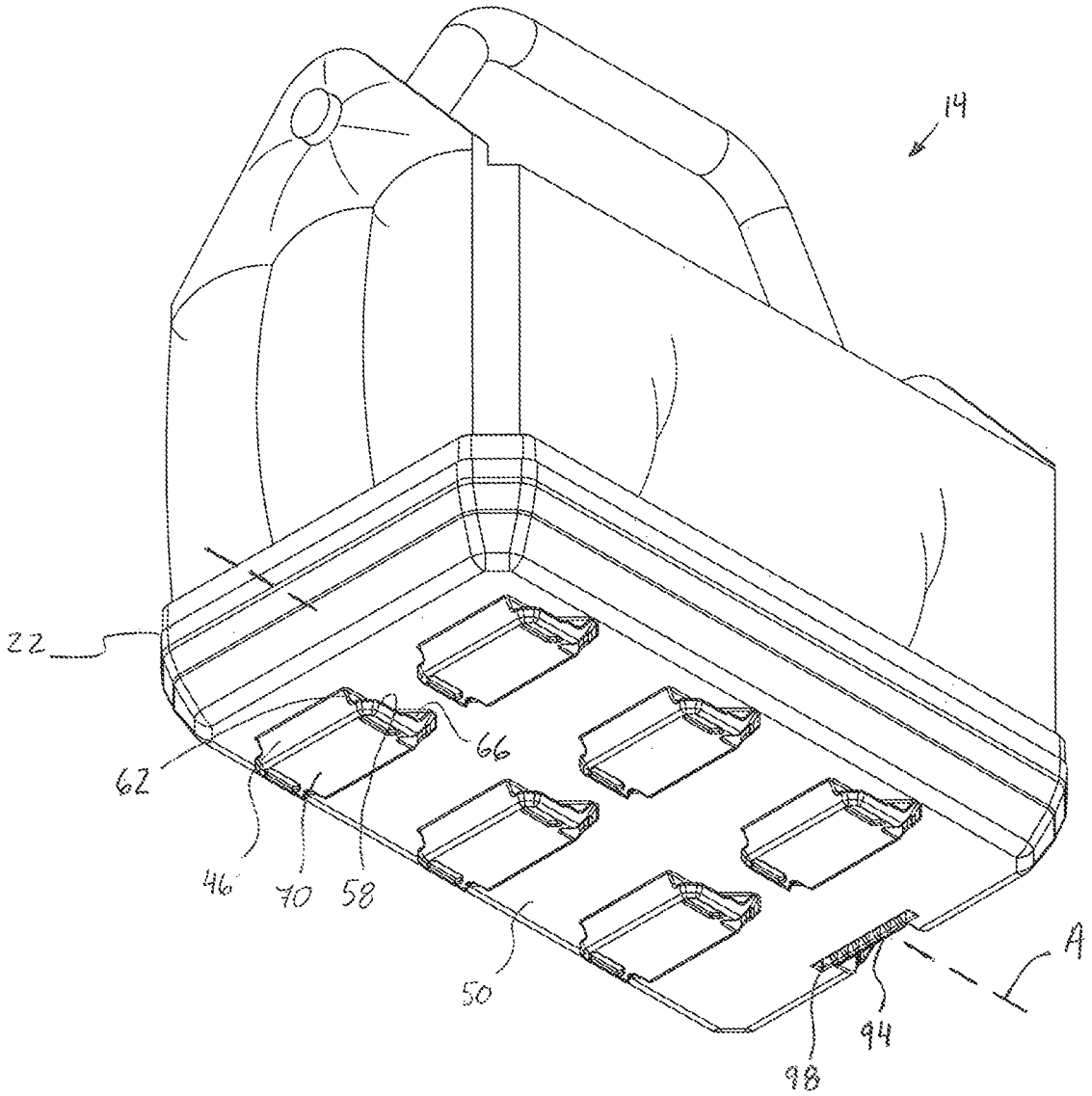
FIG. 4 is another bottom perspective view of the soft-sided storage device of FIG. 2.

With reference to FIGS. 2-4, the bag 14 includes a rigid or hard bottom member 22 (e.g., thermoform plastic, etc.) and flexible sidewalls 26 cooperating to define a storage compartment 30. The sidewalls 26 define an open top 34 for access to the storage compartment 30. A handle 38 is connected between opposite sidewalls 26 and is engageable by a user to carry the bag 14.

One or more interface or connection projections 46 are provided on the bottom member 22. In the illustrated embodiment, each projection 46 extends from a bottom surface 50 of the bottom member 22 and is configured to cooperate with a connection recess 54 (FIGS. 5-6) on the storage case 18 to interface and connect the bag 14 to the storage case 18. In the illustrated embodiment, each projection 46 is formed integrally with the bottom member 22, for example, in a thermoforming process. Each projection 46 has a channel 58 on each side of the projection 46 extending parallel to a longitudinal axis A of the bottom member 22, as best shown in FIG. 4. Each channel 58 has a front, open end 62 and a back, closed end 66 along the axis A. Each projection 46 has a planar surface 70 with a generally rectangular shape. In other embodiments, the planar surface 70 may be another shape, e.g., circular, triangular, etc. In the illustrated embodiment, there are six projections 46 arranged in three rows of two along the axis A. In other embodiments, the bag 14 may include fewer or more projections 46, and/or the projections 46 may be arranged in different patterns. The projections 46 are arranged such that the bag 14 can be supported on a surface by the projections 46 through contact with the planar surfaces 70.

Figure 9:
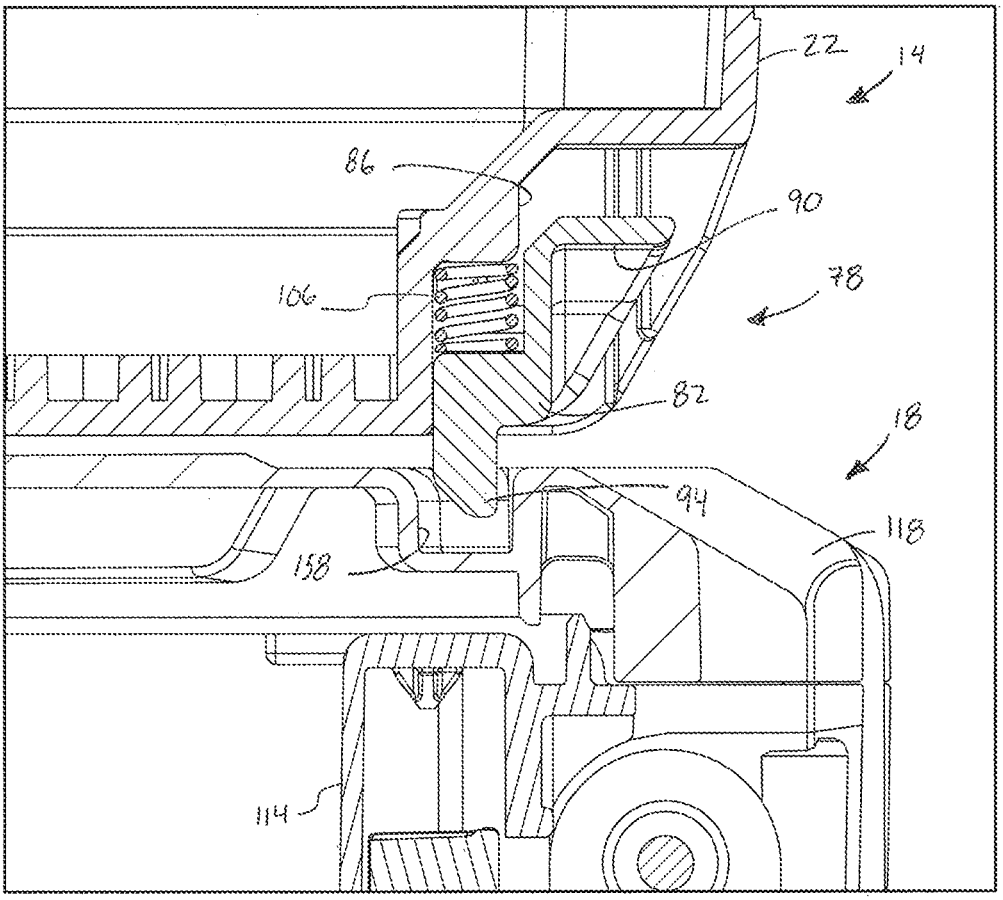
FIG. 9 is an enlarged cross-sectional view of a portion of the storage device system of FIG. 1, illustrating a latch assembly in a locking position.
Figure 10:
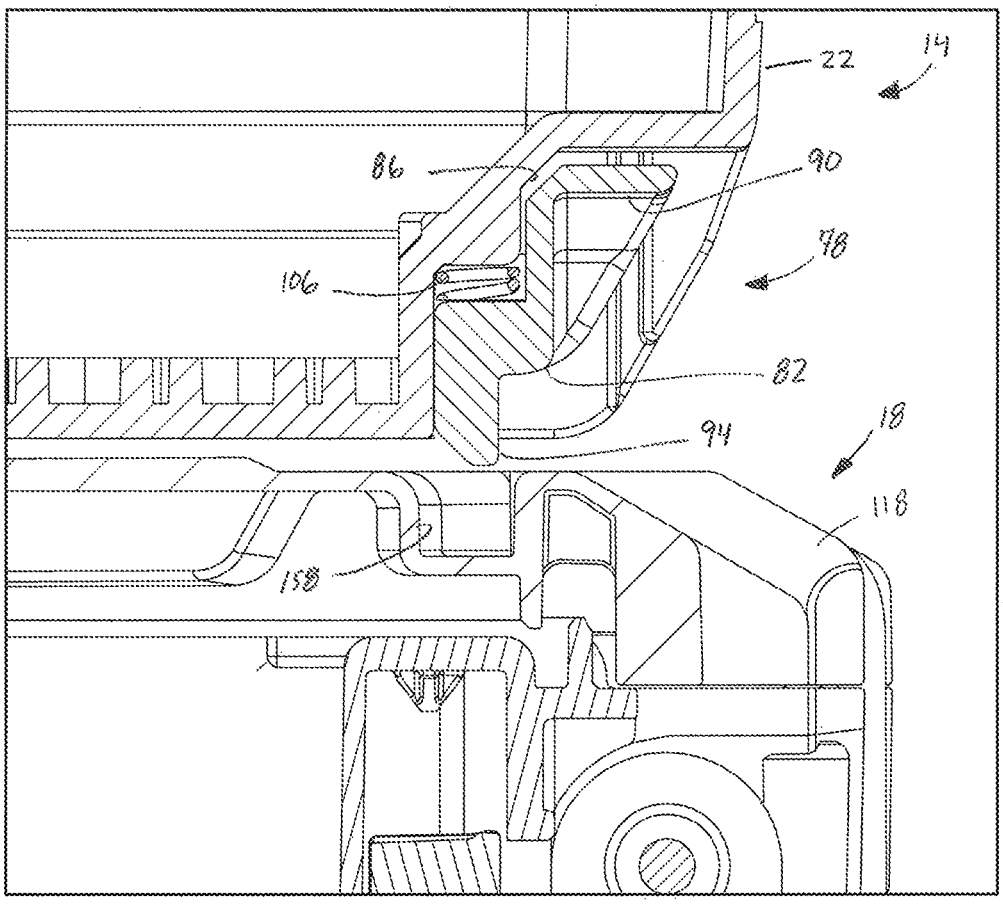
FIG. 10 is an enlarged cross-sectional view of the portion of the storage device system shown in FIG. 9, illustrating the latch assembly in an unlocking position.

The bag 14 further includes a latch assembly 78 including a latch member 82, as shown in FIG. 3. The latch assembly 78 is supported by the bottom member 22 within a latch passage 86 defined in the bottom member 22. The latch member 82 includes a grip portion 90 and an interference portion 94. The latch member 82 is slidingly movable along an axis perpendicular to the longitudinal axis A of the bottom member 22 within the latch passage 86. The interference portion 94 selectively protrudes from the latch passage 86 through a slot 98 defined in the bottom surface 50 of the bottom member 22. The interference portion 94 has a tapered surface 102 (FIG. 7) at a distal end thereof. The latch member 82 is movable between a first or locking position (FIG. 9) in which the interference portion 94 extends through the slot 98, and a second or unlocking position (FIG. 10) in which the interference portion 94 is retracted into the latch passage 86 and does not extend through the slot 98. The latch assembly 78 further includes a biasing member 106 (e.g., a compression spring) arranged to bias the latch member 82 into the locking position (FIG. 9). The latch member 82 may be urged against the biasing member 106 to the unlocking position (FIG. 10) by pushing on the grip portion 90. In the locking position, the interference portion 94 does not extend beyond the planar surfaces 70 of the projections 46.

Figure 5:
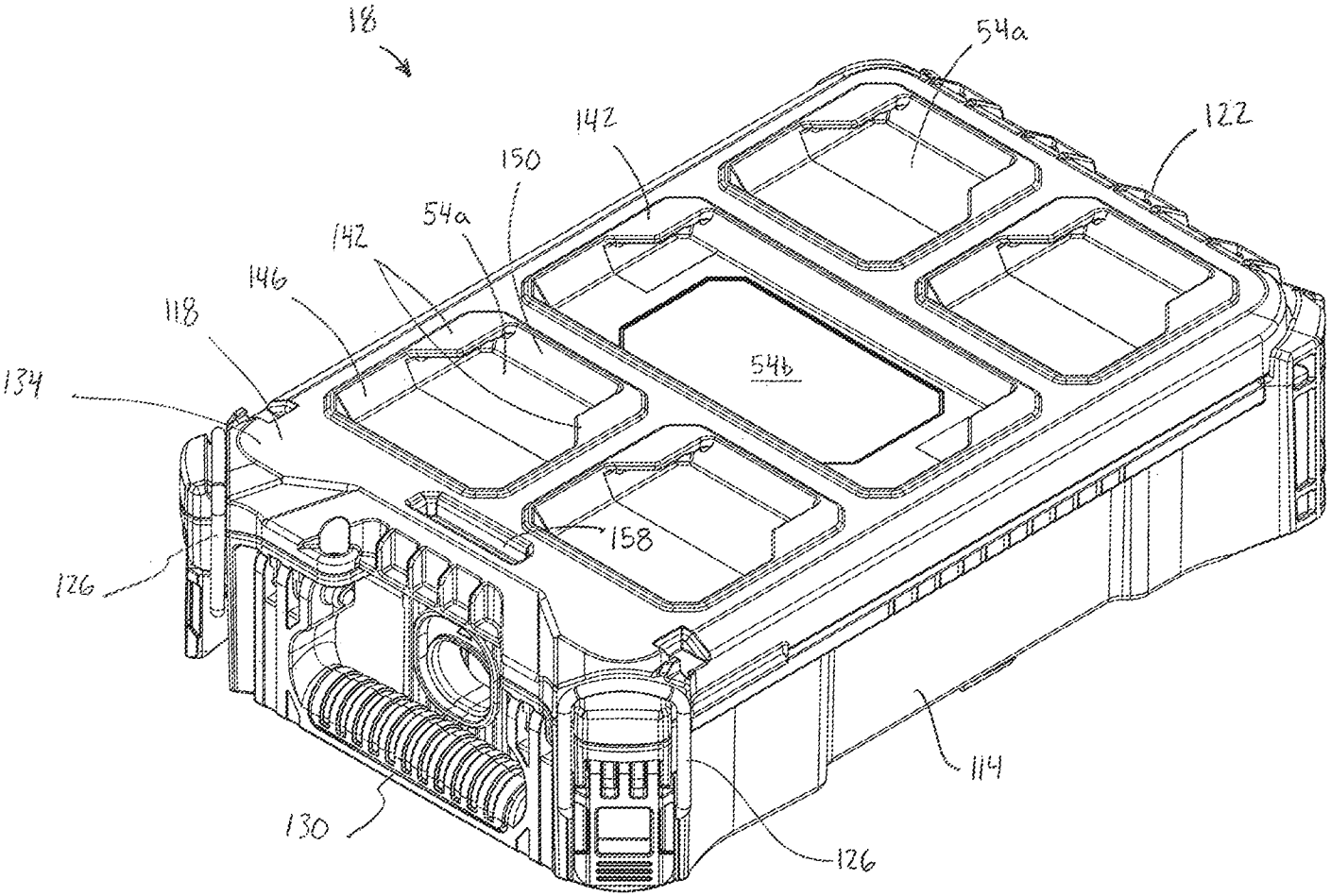
FIG. 5 is a top perspective view of the rigid storage device of FIG. 1.
Figure 6:
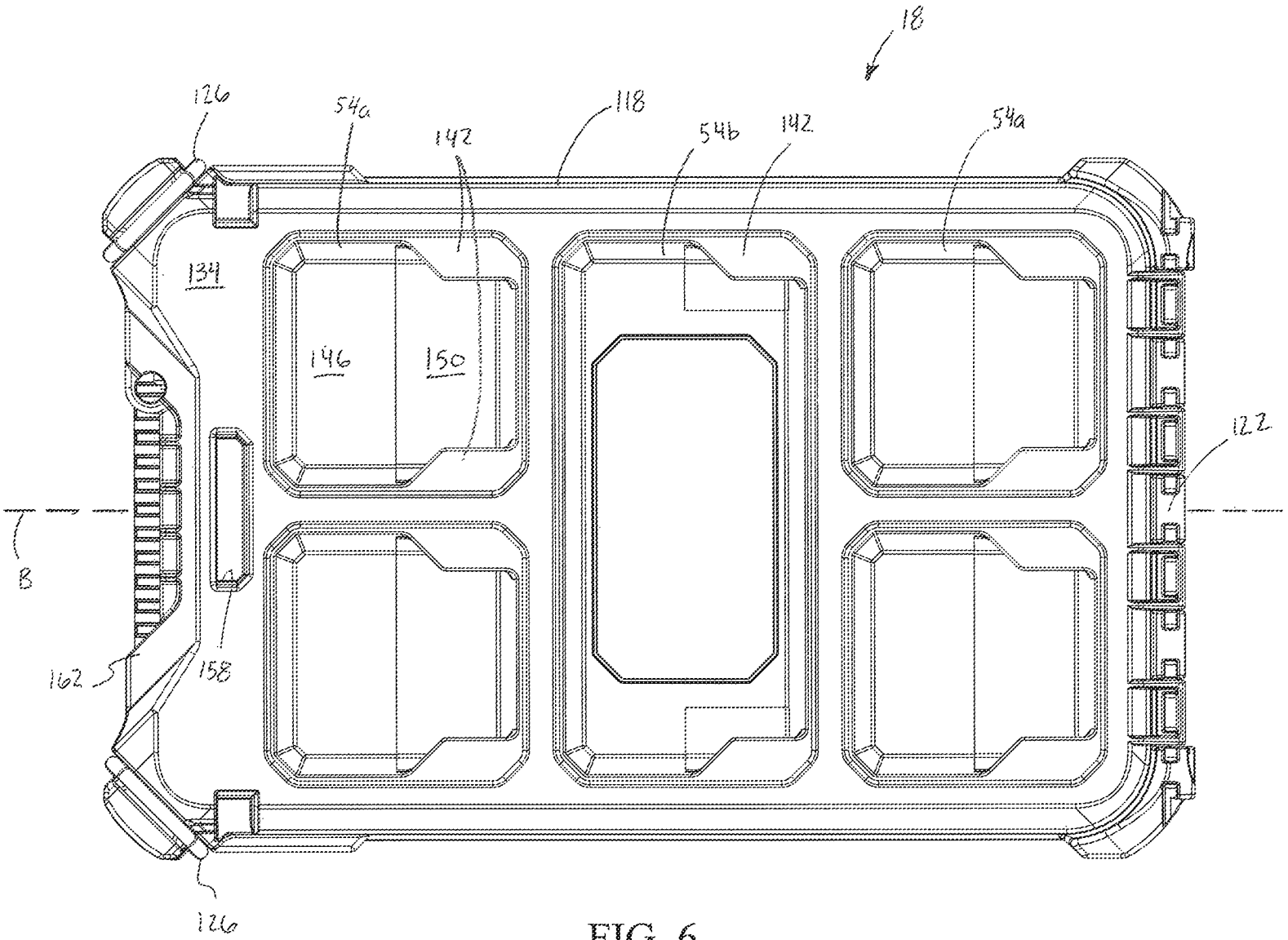
FIG. 6 is a top view of the rigid storage device of FIG. 5.
Figure 11:
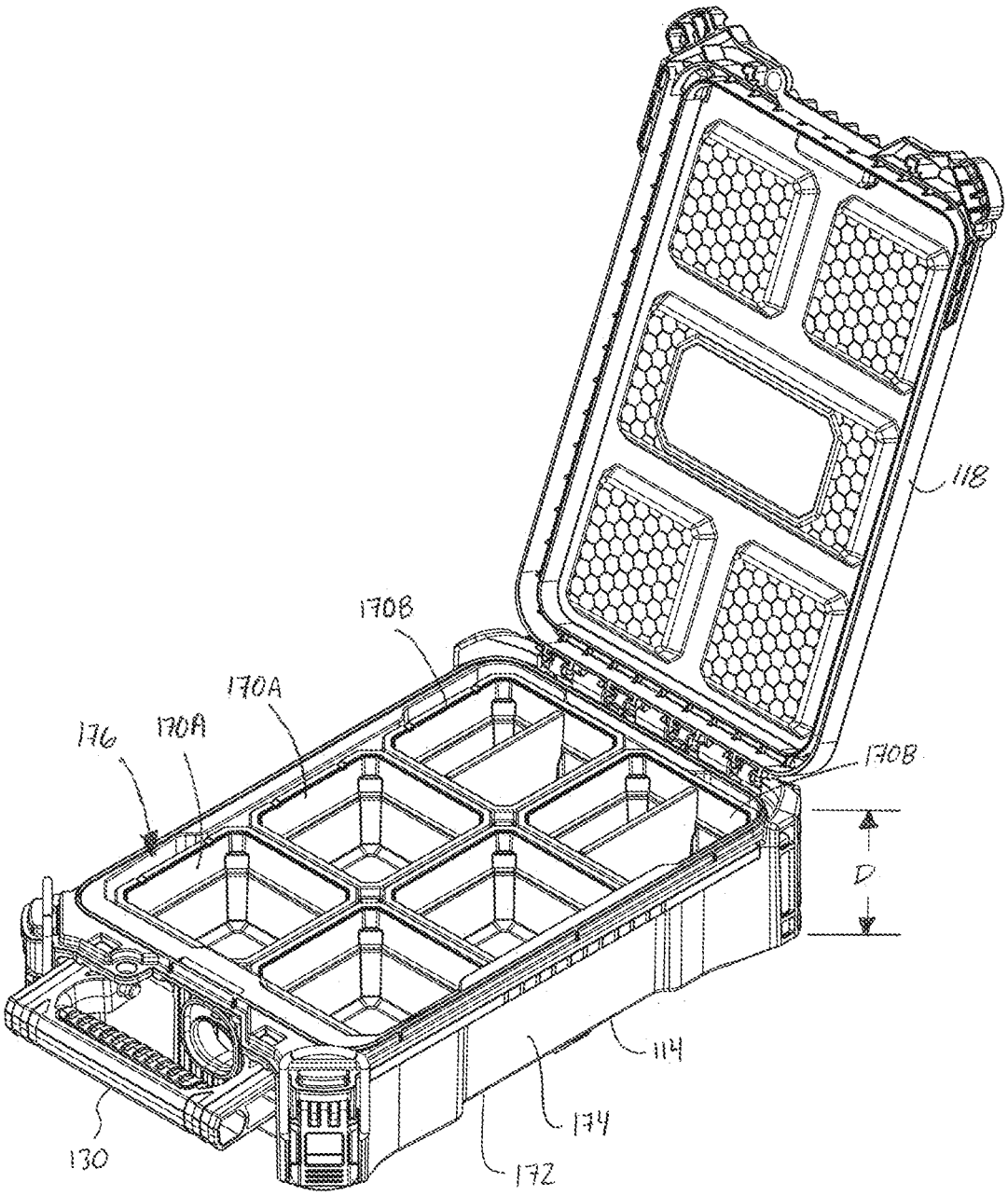
FIG. 11 is a perspective view of the rigid storage device of FIG. 5, illustrating a cover in an open position.
Figure 12:
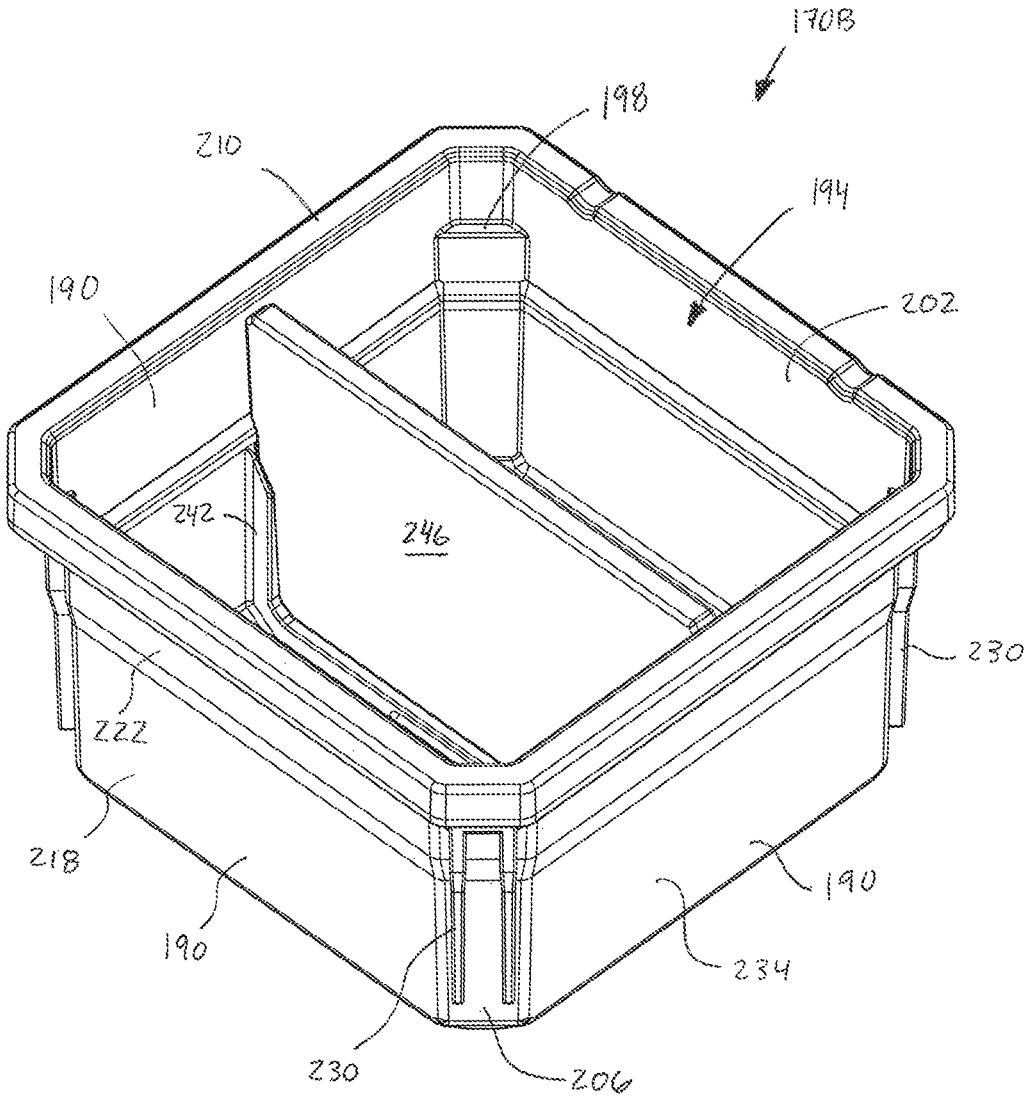
FIG. 12 is a top perspective view of a bin for use with the storage case.

With reference to FIGS. 5 and 6, the storage case 18 includes a base 114 and a top or cover 118. The cover 118 is movably coupled to the base 114 between a closed position (FIG. 5) and an open position (FIG. 11). In the illustrated embodiment, the cover 118 is pivotally coupled to the base 114 by a hinge 122. The cover 118 includes cover latches 126 to releasably secure the cover 118 in the closed position. The storage case 18 also includes a side handle 130 to facilitate independently carrying the storage case 18.

With continued reference to FIGS. 5 and 6, a top surface 134 of the cover 118 defines the connection recesses 54 that receive and cooperate with the projections 46. In the illustrated embodiment, the connection recesses 54 include two rows of two small recesses 54*a* corresponding to two rows of two projections 46 and one large recess 54*b* corresponding to a row of two projections 46. In other embodiments, the cover 118 may include different numbers of patterns of recesses 54, depending on the arrangement of the projections 46 on the bag 14. When the projections 46 are received in the connection recesses 54, the bottom surface 50 of the bottom member 22 is arranged to contact and be supported by the top surface 134 of the cover 118.

Figure 7:
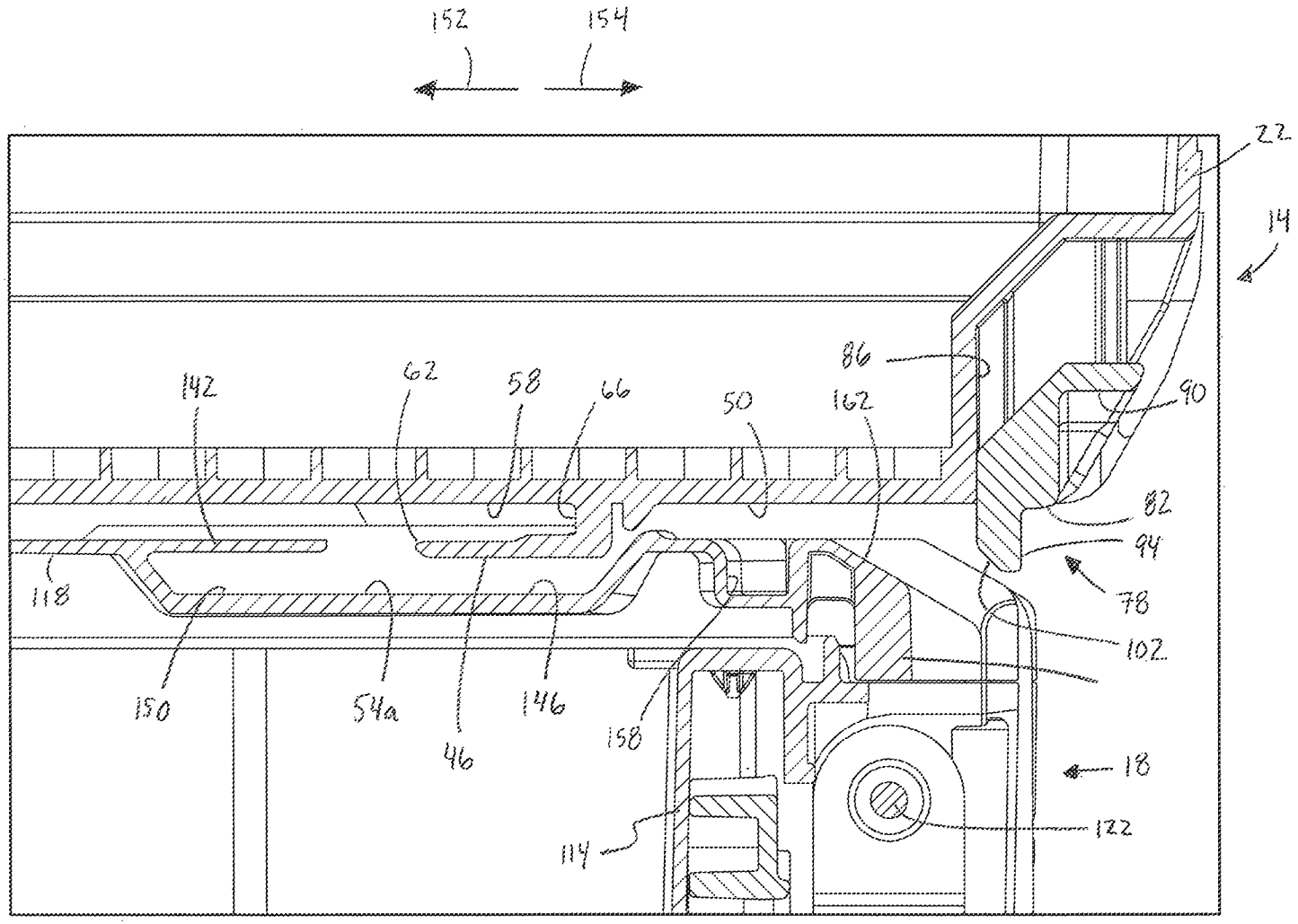
FIG. 7 is an enlarged cross-sectional view of a portion of the storage device system of FIG. 1, illustrating a bottom of the soft-sided storage device disengaged from a top of the rigid storage device.
Figure 8:
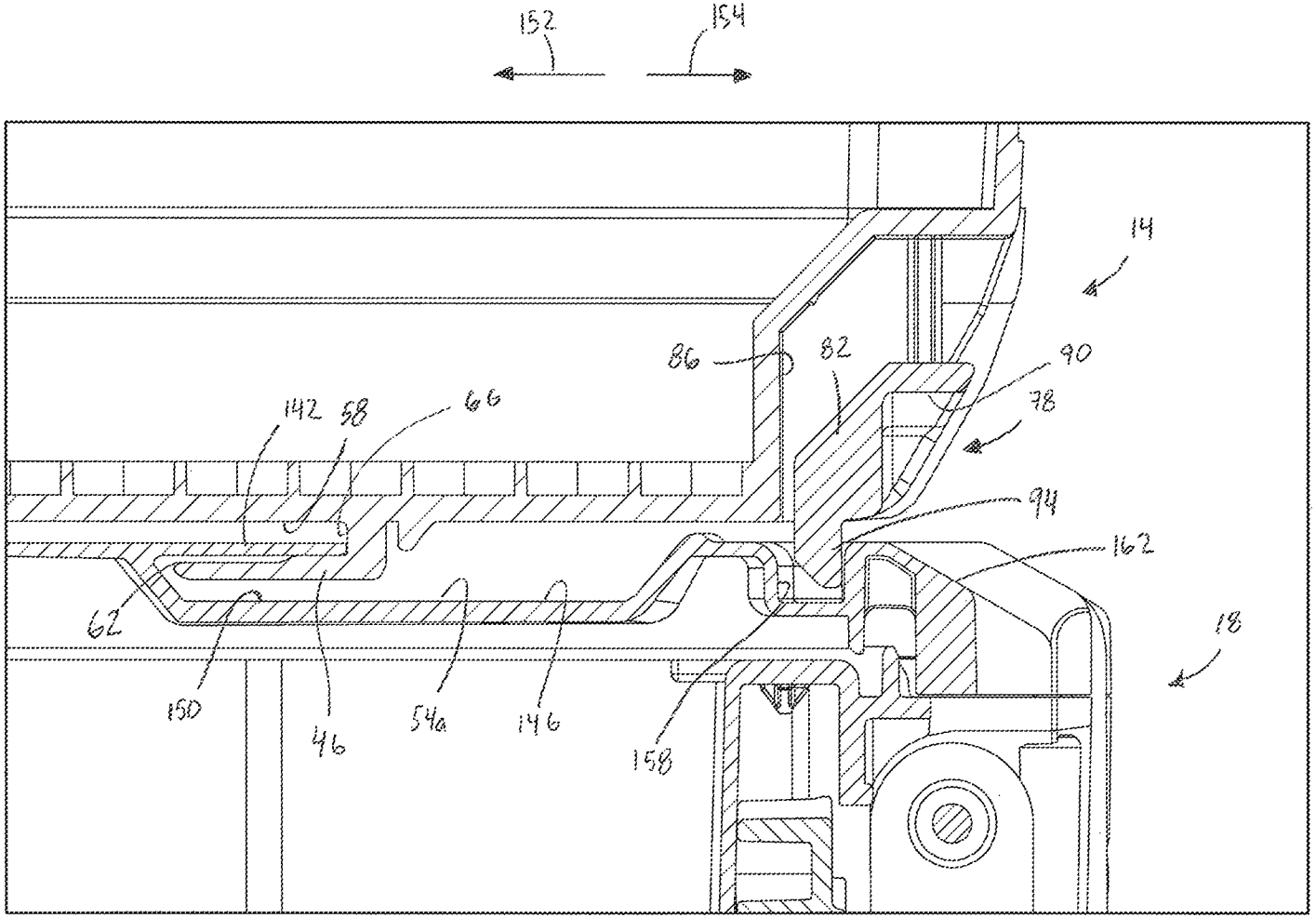
FIG. 8 is an enlarged cross-sectional view of the portion of the storage device system shown in FIG. 7, illustrating the bottom of the soft-sided storage device engaged with the top of the rigid storage device.

An interference projection or wing 142 extends into each connection recess 54 parallel to a longitudinal axis B of the cover 118 on opposite sides of the connection recess 54 from one end of the connection recess 54. Each of the wings 142 corresponds to and is configured to cooperate with a corresponding one of the channels 58 of the projection 46 received by the respective connection recess 54. Each of the wings 142 has a length that extends approximately half the connection recess 54 to define a first portion 146 of the connection recess 54 and a second portion 150 opposite the wings 142, which remains open. The second portion 150 of each connection recess 54 is sized to receive one of the projections 46 generally perpendicular to the longitudinal axis B into a first, disconnected position (FIG. 7). In the disconnected position, the projections 46 are oriented within the connection recesses 54 such that the open ends 62 of the channels 58 are nearer to the wings 142 than the closed ends 66. Once in the disconnected position, the bottom member 22 may be slid relative to the cover 118 parallel the longitudinal axes A, B in a first direction 152 toward the wings 142 such that the wings 142 are received within the channels 58 in a second, interfaced or connected position (FIG. 8). The wings 142 and the projections 46 engage within the connection recesses 54 to interface and connect the bottom member 22 with the cover 118 and prevent disconnection of the bottom member 22 from the cover 118, except in a second direction 154 opposite the first direction 152 and generally parallel to the longitudinal axes A, B. The wings 142 and the channels 58 engage one another perpendicular to the longitudinal axes A, B (i.e., perpendicular to the top surface 134 of the cover 118 and the bottom surface 50 of the bottom member 22) when carrying the bag 14 and the storage case 18 as a single unit via the handle 38 of the bag 14 (see FIG. 1).

With continued reference to FIGS. 5 and 6, the top surface 134 of the cover 118 further defines an interference or locking aperture 158. In the illustrated embodiment, the locking aperture 158 is located at one end of the cover 118. The end of the cover 118 has a sloped surface 162 adjacent the locking aperture 158. The locking aperture 158 is elongate and extends transverse to the longitudinal axis B of the cover 118 parallel to a short side of the cover 118. The locking aperture 158 is located such that when the bottom member 22 and the cover 118 are in the connected position, the locking aperture 158 is aligned with the interference portion 94 of the latch member 82. The locking aperture 158 is sized to receive and engage the interference portion 94 when the latch member 82 is in the locking position (FIG. 9). When the interference portion 94 is engaged with the locking aperture 158 in the locking position, the latch member 82 obstructs movement of the bottom member 22 relative to the cover 118 from the connected position to the disconnected position in the second direction 154, thereby inhibiting disconnection of the bag 14 from the storage case 18. In particular, the interference portion 94 interferes with the cover 118 within the locking aperture 158 such that the wings 142 cannot be removed from the channels 58 of the projections 46 in the second direction 154.

A user may couple the soft-sided bag 14 to the rigid storage case 18 to carry as a coupled unit by first, inserting the connection projections 46 of the bottom member 22 in a direction perpendicular to the cover 118 and into the second portion 150 of the connection recesses 54 of the cover 118 such that the cover 118 supports the bag 14 in the disconnected position (FIG. 7). The bottom member 22 and the cover 118 are oriented such their longitudinal axes A, B are parallel, and the latch assembly 78 is nearest the end of the cover 118 defining the locking aperture 158. The bag 14 (i.e., the bottom member 22) is then manually slid in the first direction 152 such that the wings 142 are received in the channels 58 through the open end 62 of the channels 58 until the wings 142 abut the closed end 66 of the channels 58 in the connected position (FIG. 8). As the bottom member 22 slides relative to the cover 118 from the disconnected position to the connected position, the latch member 82, which is biased into the locking position (FIGS. 7 and 9) by the biasing member 106, is urged into the unlocking position (FIG. 8) by the sloped surface 162 of the cover 118 until aligned with the locking aperture 158 when in the connected position. The biasing member 106 then automatically biases the latch member 82 back into the locking position (FIG. 9) in which the interference portion 94 is received in and engages the locking aperture 158. Alternatively, a user may urge the latch member 82 into the unlocking position (FIG. 10) by pushing on the grip portion 90 upwardly against the biasing force of the biasing member 106. The user holds the latch member 82 in the unlocking position while sliding the bag 14 in the first direction 152 from the disconnected position to the connected position. Once in the connected position (FIG. 10), the user may release the latch member 82, thereby allowing the latch member 82 to be biased into the locking position where the interference portion 94 is received in and engages the locking aperture 158. The interference portion 94 of the latch member 82 extends into the locking aperture, thereby inhibiting relative movement of the bag 14 and the storage case 18 in the second direction 154 parallel to the longitudinal axes A, B. Accordingly, the latch assembly 78 and the locking aperture 158 cooperate to secure the soft-sided bag 14 and the rigid storage case 18 in the connected position as a unit to be carried by the handle 38 of the bag 14. The handle 38 is positioned such that when the bag 14 and the storage case 18 are coupled as a unit, the handle 38 is above a center of gravity of the coupled unit.

When the soft-sided bag 14 and the rigid storage case 18 are coupled together, the user may quickly decouple them to carry or access each of the storage devices 14, 18 separately. The user first urges the latch member 82 into the unlocking position (FIG. 10) by pushing on the grip portion 90 upwardly against the biasing force of the biasing member 106. While holding the latch member 82 in the unlocking position, the user then slides the bag 14 relative to the cover 118 in the second direction 154 along the longitudinal axes A, B from the connected position (FIG. 8) to the disconnected position (FIG. 7). The wings 142 disengage from the channels 58 and the projections 46 are moved into the second portion 150 of the connection recesses 54, allowing the bag 14 to be disconnected in a direction away from and perpendicular to the top surface 134 of the cover 118.

The latch assembly 78 is dimensioned and constructed to be movable between the locking and unlocking positions to couple the bag 14 to the cover 118. The latch assembly 78 does not interfere with opening the storage case 18 so that the storage case 18 on the bottom will still be able to be opened with the soft-sided bag 14 attached to the cover 118.

It should be understood that, in other constructions, multiple latch assemblies 78 and corresponding locking apertures 158 may be provided on the bag 14 and the storage case 18. Such an arrangement may, for example, provide an increased connection between the storage devices 14, 18, balance or reduce the load on a given latch assembly, etc.

It should also be understood that, in other constructions, the latch assembly 78 and the locking aperture 158 may be reversed (e.g., the movable latch member 82 and the biasing member 106 may be supported on the cover 118 or the base 114 of the storage case 18, and the locking aperture 158 may be defined by the bottom member 22 of the bag 14). Additionally or alternatively, the relative locations of the projections 46 and the recesses 54 may be reversed (e.g., the projections 46 may extend from the cover 118 of the storage case 18, and the recesses 54 may be formed in the bottom member 22 of the soft-sided bag 14).

As shown in FIG. 1, the storage devices 14, 18 have approximately the same perimeter dimensions. There is one pair of latch assembly 78 and locking aperture 158 at one end of the storage devices 14, 18. However, in alternate embodiments, the storage devices 14, 18 may have different perimeter dimensions (e.g., the bag 14 is shorter than the storage case 18). In such embodiments, the bag 14 may have fewer projections 46 arranged such that the bag 14 may be connected to the storage case 18 in substantially the same manner as described above, except where one or more of the connection recesses 54 in the cover 118 does not receive a projection 46. Additionally or alternatively, in some embodiments multiple soft-sided bags 14 having smaller dimensions than the storage case 18 may be simultaneously connected to the storage case 18.

Figure 13:
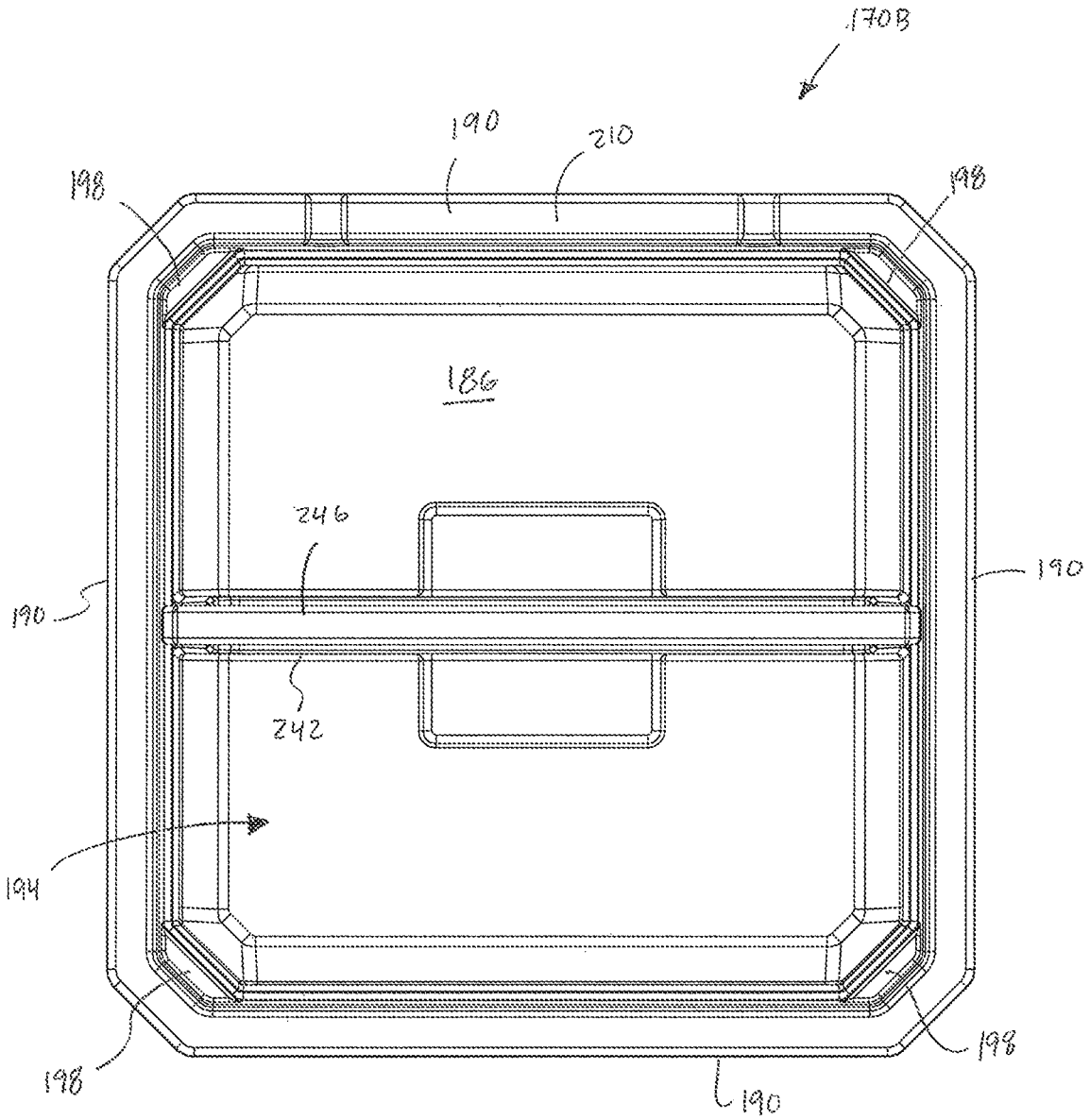
FIG. 13 is a top view of the bin of FIG. 12.

As shown in FIG. 11, a plurality of bins 170A, 170B, or inserts, are positioned within the base 114. The base 114 includes a bottom wall 172 and sidewalls 174 extending from the bottom wall defining an interior 176 with a depth D. The bins 170A, 170B are independently removable from the storage case 18 when the storage case 18 is open (i.e., the cover 118 is in the open position), as shown in FIG. 11. The bins 170A, 170B include relatively tall, or deep, bins 170A (FIG. 18) and relatively short, or shallow, bins 170B (FIGS. 12-17). The illustrated bins 170A, 170B are generally composed of plastic, but may alternatively be made of other materials. Each of the illustrated bins 170A, 170B is generally square in shape when viewed from above (FIG. 13). In other embodiments, the bins 170A, 170B may have other shapes (e.g., triangular, octagonal, circular, etc.). In the illustrated embodiment, the bins 170A, 170B are arranged within the base 114 as a grid of six (i.e., three rows of two). In other embodiments, the base 114 may be shaped and sized to receive a larger or smaller number of bins, and/or the bins 170A, 170B may be arranged within the base 114 in other patterns.

Figure 14:
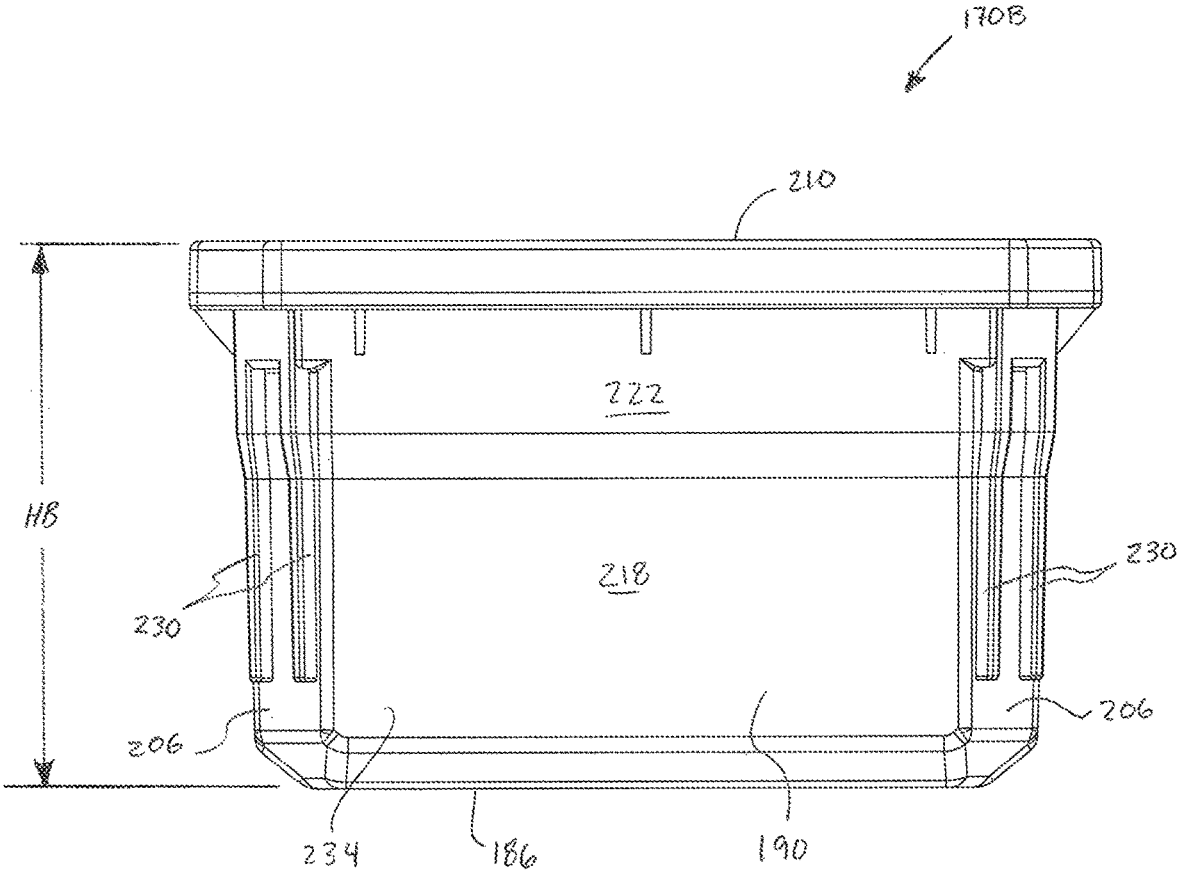
FIG. 14 is a side view of the bin of FIG. 12.
Figure 15:
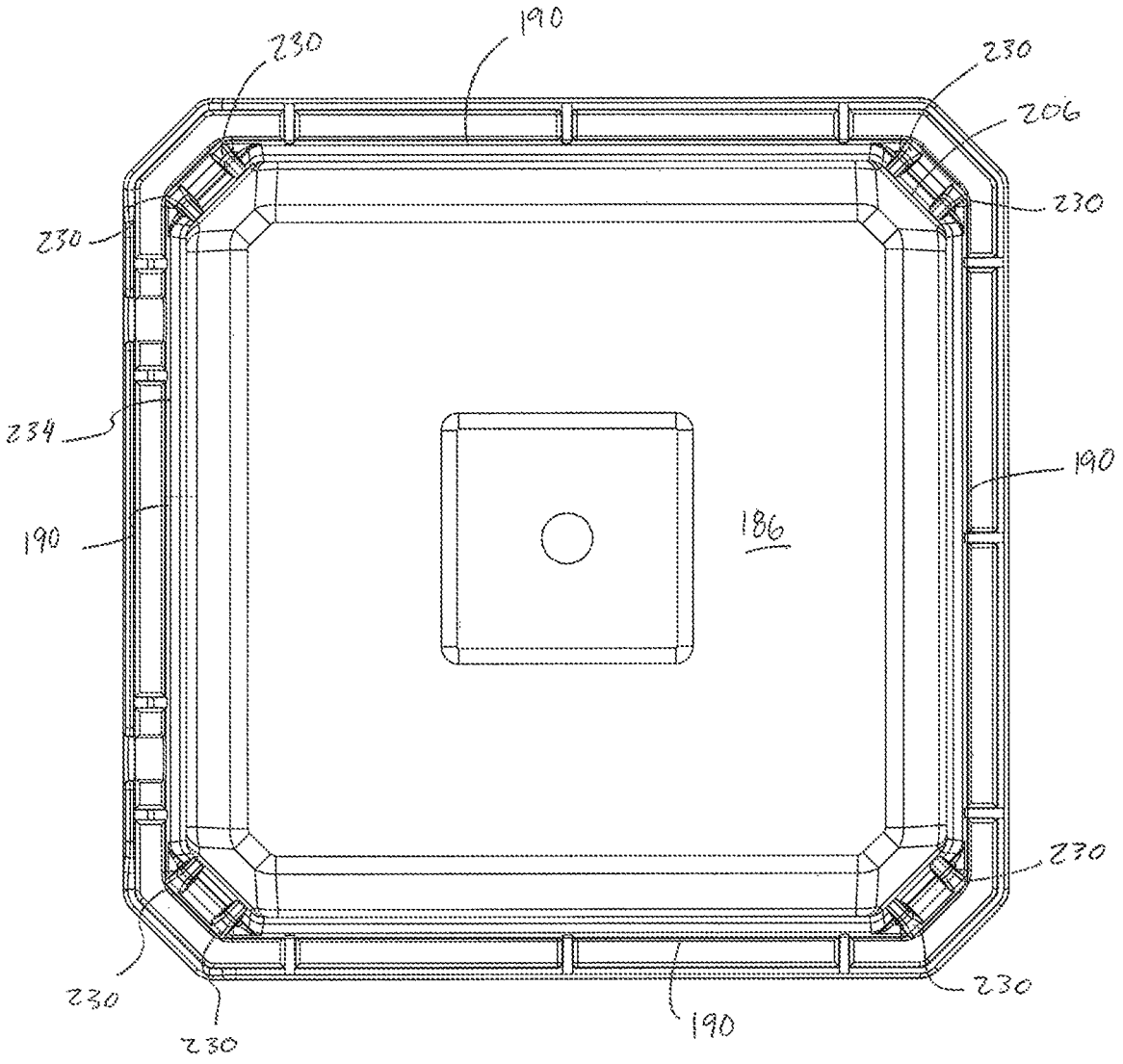
FIG. 15 is a bottom view of the bin of FIG. 12.

FIGS. 12-16 illustrate one of the relatively short bins 170B in detail. The bin 170B includes a bottom wall 186 and four sidewalls 190 extending generally perpendicularly from the bottom wall 186. The bottom wall 186 and the sidewalls 190 define a storage recess or space 194. Each of the relatively short bins 170B has a height HB (FIG. 14).

Figure 17:
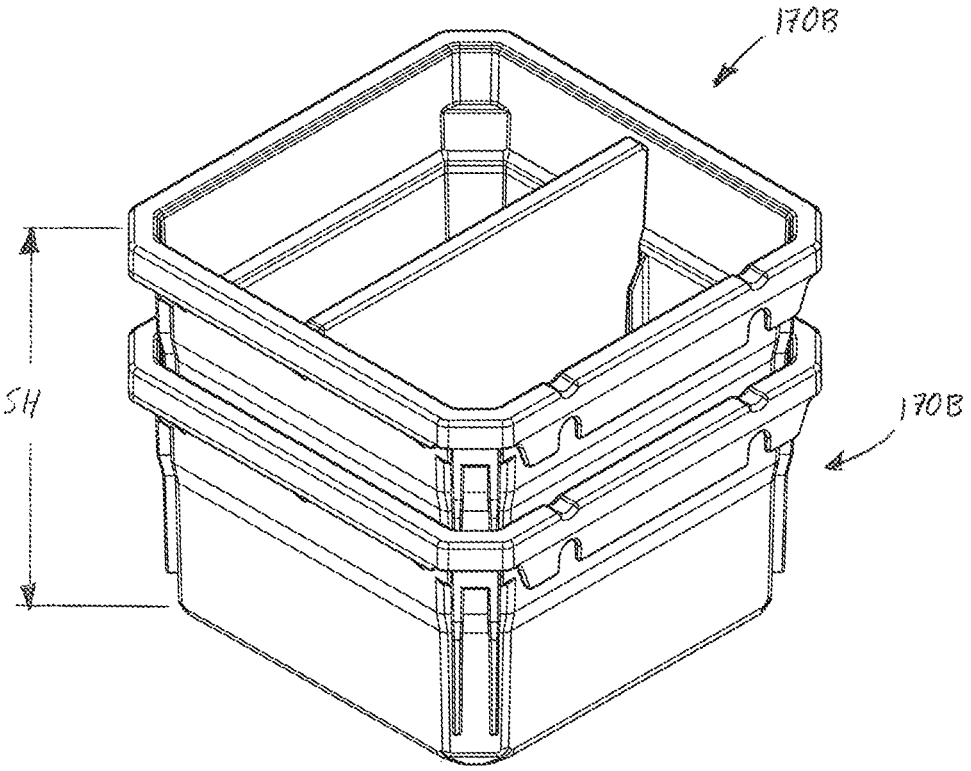
FIG. 17 illustrates two relatively short bins stacked on top of one another.

The bin 170B also includes ledges 198 formed on an inner surface 202 of the bin 170B at each corner 206 between adjacent sidewalls 190. The ledges 198 are positioned at a depth below a top edge 210 of the sidewalls 190 and a height above the bottom wall 186. In the illustrated embodiment, the ledges 198 are located at a depth that is approximately a quarter of the height HB below the top edge 210. In some embodiments the ledge 198 may extend around the perimeter of the sidewalls 190. The ledges 198 are configured to engage and support another bin when, for example, two relatively short bins 170B are stacked together, as best shown in FIG. 17. The bottom wall 186 at each corner 206 of the upper bin 170B is supported on each ledge 198 of the lower bin 170B. Each of the sidewalls 190 includes a lower, first portion 218 and an upper, second portion 222 that are stepped such that the first portion 218 has a smaller outer dimension than the second portion 222. As such, the sidewalls 190 of the upper bin 170B are partially received in the storage space 194 of the lower bin 170B up to the ledges 198 of the lower bin 170B. When stacked, the two relatively short bins 170B have a stacked height SH (FIG. 17). In other embodiments, more than two bins 170B may be stacked. Due to the top bin 170B being partially received in the bottom bin 170B, the stacked height SH is less than the total height of the two bins 170B (i.e., two times the height HB of the bins 170B).

The bin 170B further includes ribs 230 formed on an outer surface 234 of the bin 170B at the corners 206 between adjacent sidewalls 190. Each of the ribs 230 protrudes outwardly from the outer surface 234 and extends down from the top edge 210 toward the bottom wall 186. In the illustrated embodiment, each of the corners 206 has two ribs 230. In some embodiments, ribs may be formed on the sidewalls 190 between the corners 206 in addition to or in place of the ribs 230 formed at the corners 206.

Figure 19:
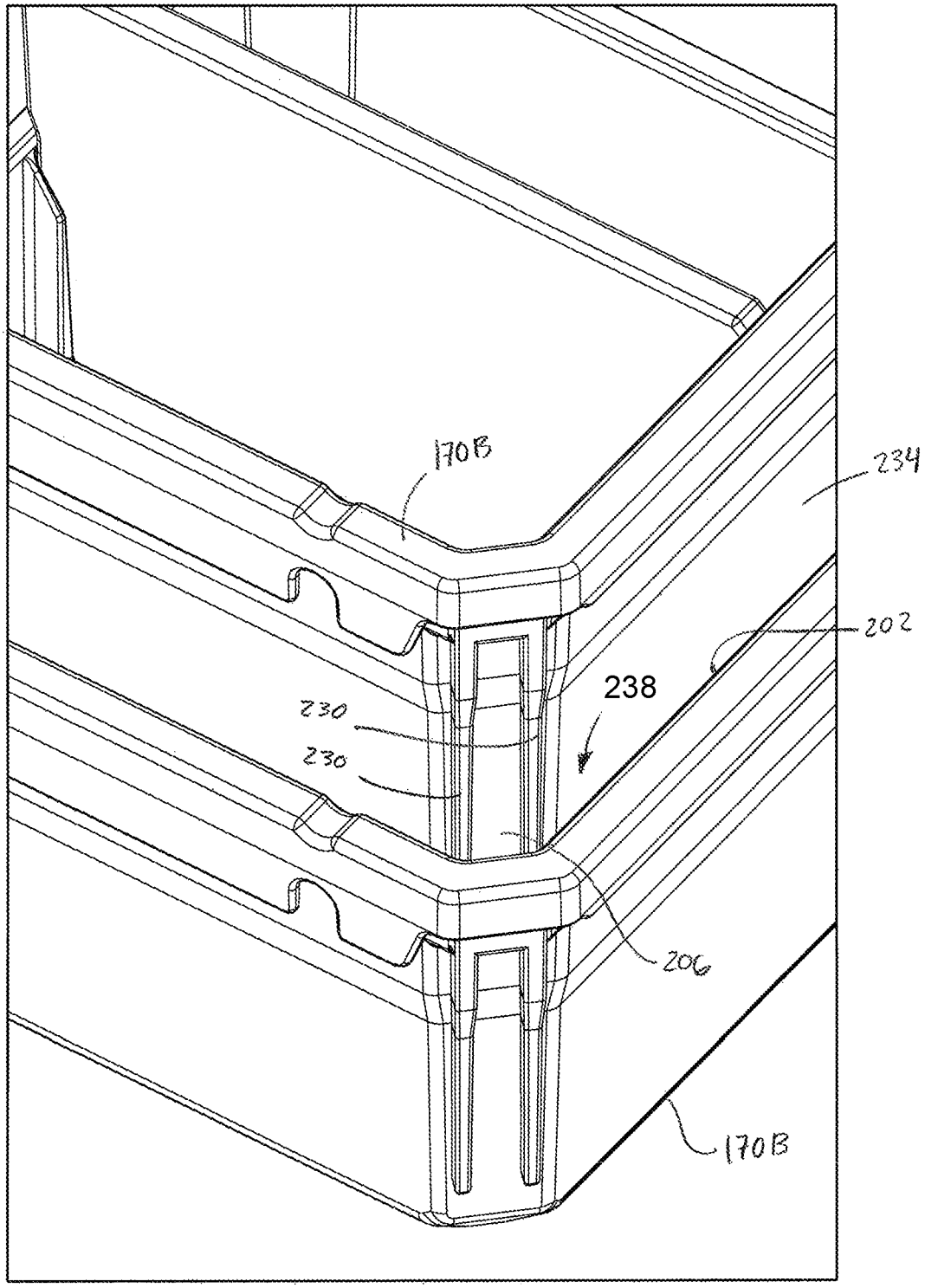
FIG. 19 is an enlarged view of portions of the two relatively short bins of FIG. 17 stacked together.

As best shown in FIG. 19, when two or more bins 170B are stacked, the ribs 230 protrude from the outer surface 234 of the upper bin 170B to contact and engage the inner surface 202 of the lower bin 170B to space apart the sidewalls 190 of the stacked bins 170B. Accordingly, the ribs 230 help maintain a space or gap 238 between the stacked bins 170B for airflow, thereby inhibiting the stacked bins 170B from getting stuck together due to vacuum effects. In other words, the gap 238 provides fluid communication between a cavity formed between the inner surface 202 of the lower bin 170B and the outer surface 234 of the bin 170B below the ledge 198 of the lower bin 170B and atmosphere, thereby inhibiting a vacuum from forming when the bins 170B are stacked.

Figure 16:
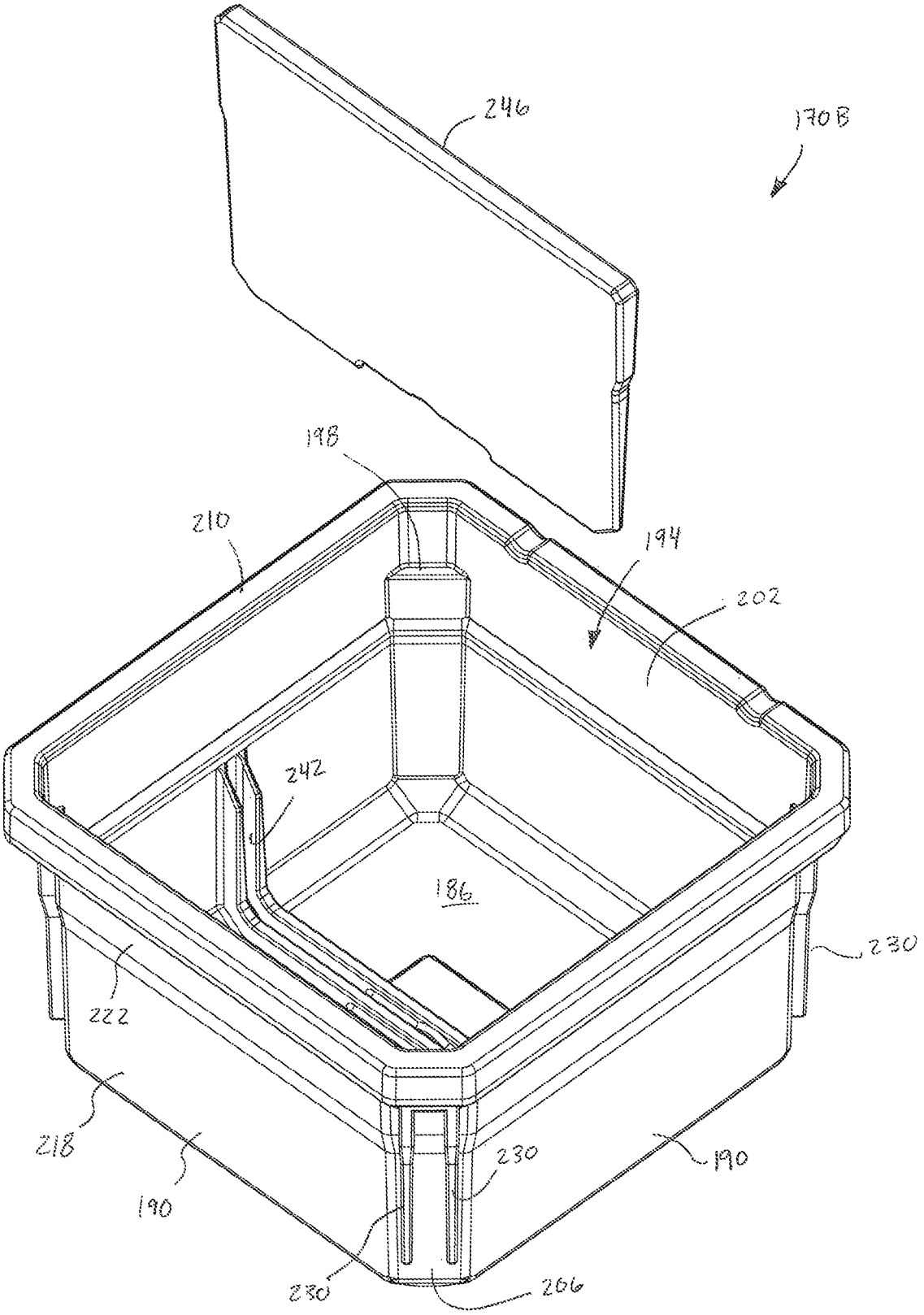
FIG. 16 is an exploded perspective view of the bin of FIG. 12.

In some embodiments, such as the illustrated embodiment, the bin 170B includes a track 242 formed on the inner surface 202 of the bin 170B, as best shown in FIG. 16. The track 242 extends partially along two opposing sidewalls 190 and along the bottom wall 186. The track 242 is configured to removably receive a dividing wall 246, or partition, for dividing the storage space 194 into separate compartments. The illustrated dividing wall 246 splits the storage space 194 in half. In other embodiments, the track 242 and the dividing wall 246 may be positioned to split the storage space 194 into unequally sized compartments, or the bin 170B may include multiple tracks for receiving multiple dividing walls. In some embodiments, the track 242 and the dividing wall 246 may be omitted. In the illustrated embodiment, the height of the dividing wall 246 inhibits a bin 170B from being stacked on a bin 170B with a dividing wall 246. In other embodiments, the dividing wall 246 may have a height that does not interfere with stacking the bins 170B.

Figure 18:
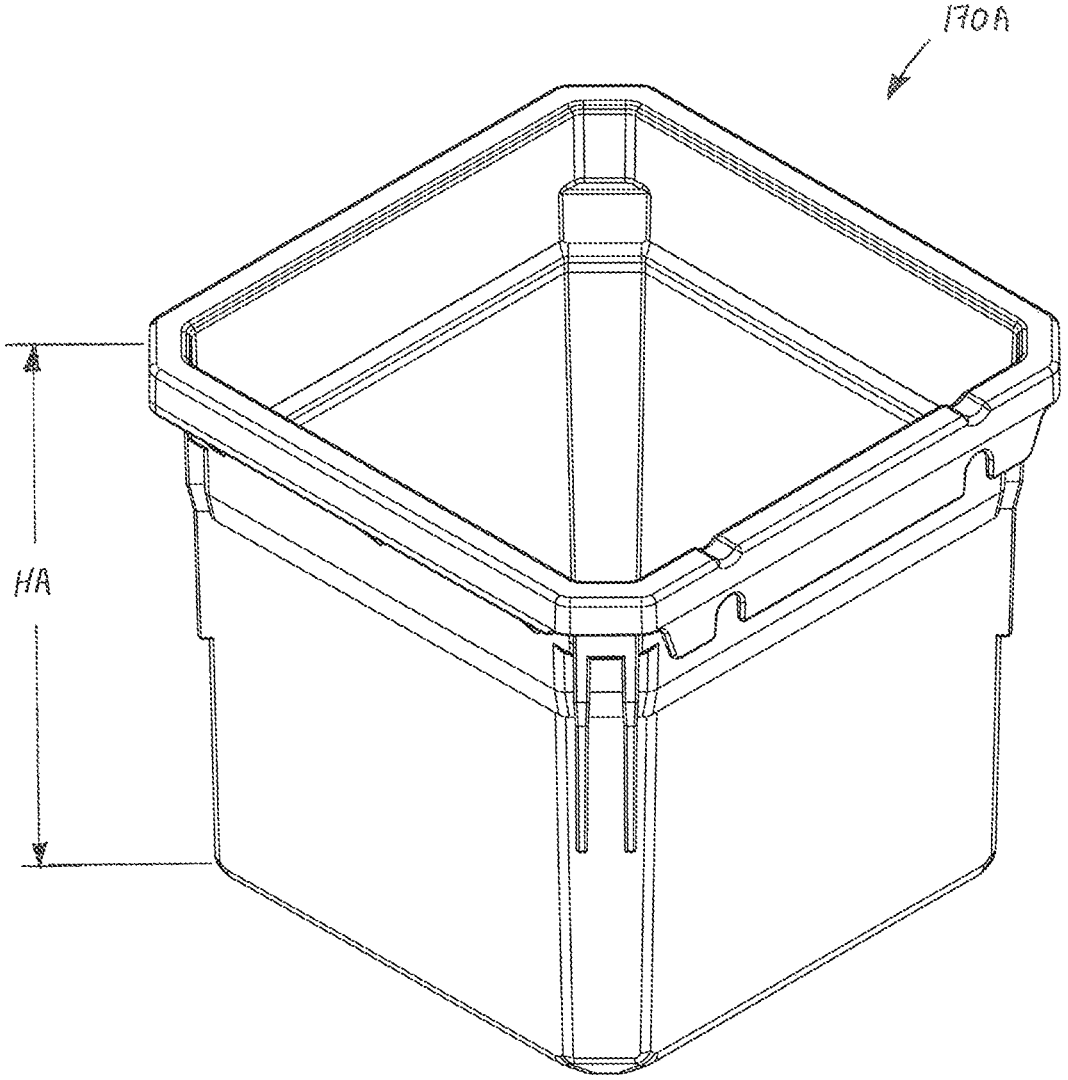
FIG. 18 illustrates a relatively tall bin.

FIG. 18 illustrates one of the relatively tall bins 170A. The relatively tall bin 170A is substantially similar to the relatively short bins 170B. However, the relatively tall bin 170A has a height HA greater than the height HB of the relatively short bin 170B. The stacked height SH of two relatively short bins 170B, when stacked together, is generally equal to the height HA of the relatively tall bin 170A. In addition, the height HB of the one relatively tall bin 170A and the stacked height SH of two relatively short bins 170B stacked together are each generally equal to the height or depth D of the base 114 of the storage device 18.

Figure 20:
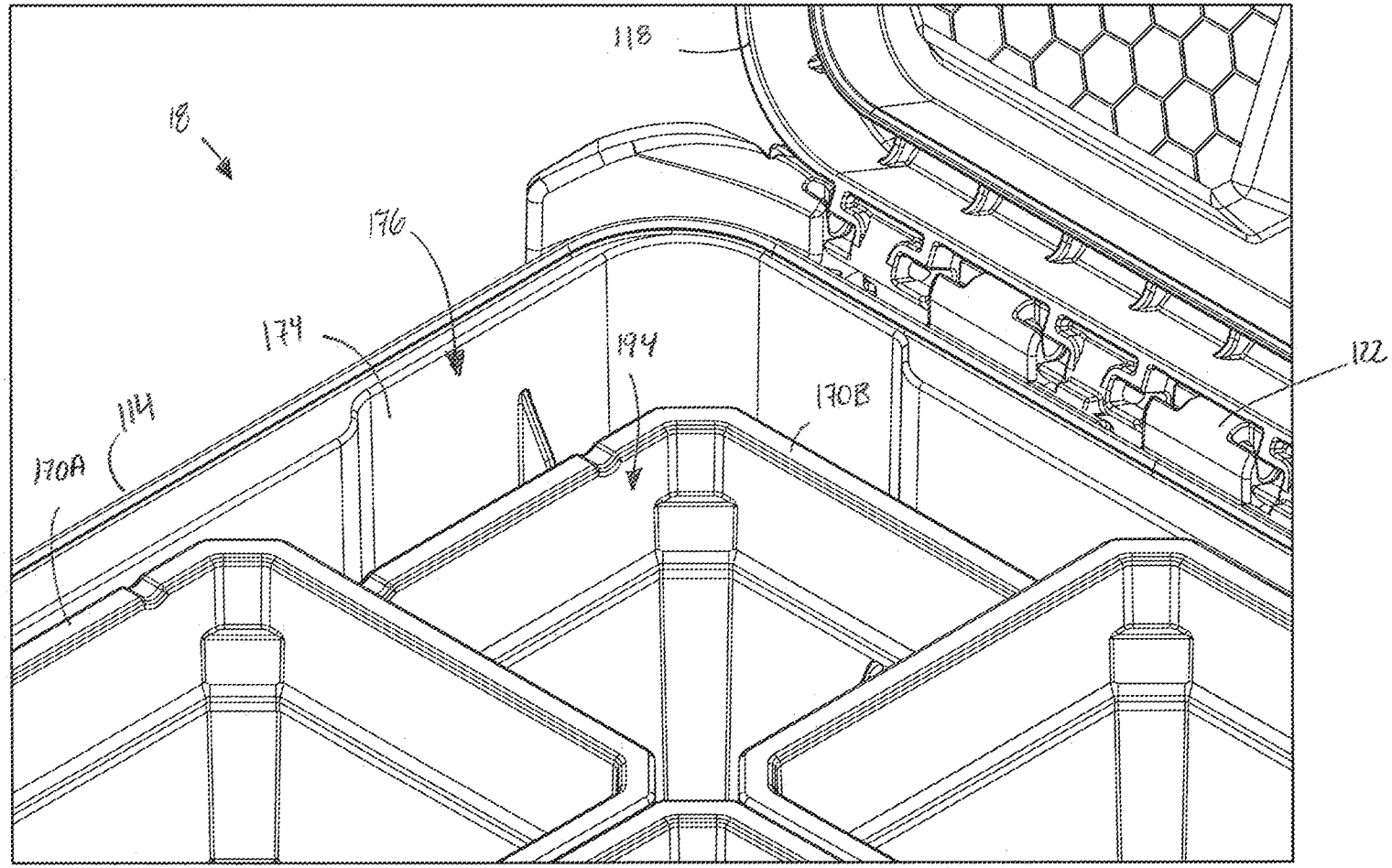
FIG. 20 is an enlarged view of a portion of the storage case in the open position.

As best shown in FIG. 20, a user may remove an upper bin of two stacked relatively short bins 170B within the base 114 of the storage case 18 to allow access to the storage space 194 of the lower bin 170B. Accordingly, the stacked bins 170B within the storage device 18 provide additional storage and organizing space that can be easily reconfigured and arranged as necessary.

Although the invention has been described in detail with reference to certain preferred embodiments, variations and modifications exist within the scope and spirit of one or more independent aspects of the invention as described.

One or more independent features and/or independent advantages of the invention may be set forth in the claims.

The invention claimed is:

1. A storage device system, comprising:

a storage case having a base and a cover coupled to the base; and a plurality of insertable bins removably positioned within an interior of the base, the insertable bins including a first bin and a second bin configured to be stackable on the first bin, the first bin having a ledge formed on an inner surface of the first bin, the ledge configured to engage and support the second bin when the second bin is stacked on the first bin, the second bin comprising a plurality of sidewalls, a plurality of corners, each located between a pair of adjacent sidewalls and a rib on an outer surface of each corner, the rib configured to engage an inner surface of the first bin to inhibit suctioning when the second bin is stacked on the first bin, wherein the each rib extends vertically along the outer surface of the corner more than halfway to a bottom edge of the second bin.

2. The storage device system of claim 1, wherein the ledge extends from the inner surface and engages a bottom surface of the second bin when the second bin is stacked on the first bin.

3. The storage device system of claim 1, wherein the rib engages the inner surface of the first bin at a location above the ledge when the second bin is stacked on the first bin.

4. The storage device system of claim 3, wherein the rib forms a gap between the outer surface of the second bin and the inner surface of the first bin when the second bin is stacked on the first bin.

5. The storage device system of claim 1, wherein each of the insertable bins defines a storage recess.

6. The storage device system of claim 5, wherein the second bin is at least partially received in the storage recess of the first bin when the second bin is stacked on the first bin.

7. The storage device system of claim 1, wherein the plurality of insertable bins includes a third bin having a height equal to a stacked height of the first bin and the second bin when the second bin is stacked on the first bin.

8. The storage device system of claim 1, wherein each corner of the second bin includes a second rib on the outer surface of the corner parallel to the rib.

9. A storage device system, comprising:

a storage case having a base and a cover coupled to the base, wherein the cover includes a plurality of connection recesses each including at least one wing extending into the connection recess;

a dividing wall; and a plurality of insertable bins removably positioned within an interior of the base, the plurality of insertable bins comprising:

a first bin having a first height; and a set of second bins each having a second height less than the first height, wherein each bin of the set of second bins comprises a bottom wall and a sidewall extending from the bottom wall to define a storage recess, and a track extending vertically along the sidewall that is configured to receive the dividing wall such that the storage recess within the respective second bin is divided into separate storage recesses;

wherein the set of second bins is configured to be stackable and have a stacked height when stacked;

wherein a height of the track along the sidewall is less than the second height;

wherein a height of the dividing wall is less than the second height.

10. The storage device system of claim 9, wherein a depth of the interior of the base, the first height, and the stacked height are equal, and wherein the track is positioned such that the dividing wall divides the storage recess in half.

11. The storage device system of claim 9 wherein, when the set of second bins are stacked, one bin of the set of second bins is partially received in the storage recess of another bin of the set of second bins.

12. The storage device system of claim 9, wherein each bin of the set of second bins further comprises a plurality of corners and a ledge formed on an inner surface of each corner thereof, and wherein the ledges are configured to engage and support one bin of the set of second bins when the set of second bins is stacked, wherein an uppermost end of the track is located at a lower position along the sidewall than the ledges.

13. The storage device system of claim 12, wherein the track of each bin of the second set of bins comprises a pair of opposing walls extending inward from an inner surface of the sidewall defining a gap within which the dividing wall is received.

14. The storage device system of claim 13, wherein the inner surface of the sidewall of each bin of the second set of bins includes an angled section that extends inward from a lower end of the sidewall toward the bottom wall, wherein the dividing wall includes a pair of opposing bottom corners angled to engage the angled section of the inner surface of the sidewall.

15. The storage device system of claim 14, wherein the dividing wall includes an upper edge and a lower edge extending between the pair of opposing bottom corners, wherein a length of the lower edge is less than a length of the upper edge.

16. The storage device system of claim 9, wherein each bin of the set of second bins has a rib on an outer surface thereof to inhibit suctioning when the set of second bins is stacked.

* * * * *